US009631384B2

(12) United States Patent
Jacobs et al.

(10) Patent No.: US 9,631,384 B2
(45) Date of Patent: Apr. 25, 2017

(54) RECONFIGURABLE SEATING SYSTEMS

(71) Applicants: Frederick Jacobs, Holland, MI (US); Matthew Jacobs, Holland, MI (US); Terry Plumert, Grand Haven, MI (US)

(72) Inventors: Frederick Jacobs, Holland, MI (US); Matthew Jacobs, Holland, MI (US); Terry Plumert, Grand Haven, MI (US)

( * ) Notice: Subject to any disclaimer, the term of this patent is extended or adjusted under 35 U.S.C. 154(b) by 112 days.

(21) Appl. No.: 14/728,401

(22) Filed: Jun. 2, 2015

(65) Prior Publication Data

US 2015/0345161 A1 Dec. 3, 2015

Related U.S. Application Data

(60) Provisional application No. 62/006,363, filed on Jun. 2, 2014, provisional application No. 62/018,854, filed on Jun. 30, 2014, provisional application No. 62/143,079, filed on Apr. 4, 2015, provisional application No. 62/149,596, filed on Apr. 19, 2015, provisional application No. 62/159,791, filed on May 11, 2015.

(51) Int. Cl.

| | |
|---|---|
| ***E04H 3/12*** | (2006.01) |
| ***A47C 1/121*** | (2006.01) |
| ***A47C 1/124*** | (2006.01) |
| ***E04H 3/30*** | (2006.01) |
| *A47C 1/12* | (2006.01) |

(52) U.S. Cl.

CPC ..... *E04H 3/126* (2013.01); *A47C 1/121* (2013.01); *A47C 1/124* (2013.01); *E04H 3/30* (2013.01); *A47C 1/12* (2013.01)

(58) Field of Classification Search

CPC ..... A47C 1/12; A47C 1/121; A47C 1/124; E04H 3/126; E04H 3/30

USPC ..... 52/6, 8, 9; 297/236, 232

See application file for complete search history.

(56) References Cited

U.S. PATENT DOCUMENTS

| | | | | | |
|---|---|---|---|---|---|
| 3,443,835 | A * | 5/1969 | Brunskole | A47C 1/126 | 297/35 |
| 3,703,312 | A * | 11/1972 | Chapman | A47C 1/126 | 297/15 |
| 4,189,876 | A * | 2/1980 | Crossman | A47C 1/126 | 52/9 |
| 5,328,238 | A * | 7/1994 | Yamazaki | A47C 1/126 | 297/332 |
| 5,375,914 | A * | 12/1994 | Donnelly | A47C 1/121 | 297/335 |
| 5,385,323 | A * | 1/1995 | Garelick | A47C 3/28 | 248/157 |
| 5,655,816 | A * | 8/1997 | Magnuson | B60N 2/242 | 297/232 |
| 5,678,889 | A * | 10/1997 | Purcell, Jr. | A47C 1/12 | 297/232 |
| 5,960,589 | A * | 10/1999 | Youngquist | E04H 3/12 | 52/6 |
| 6,683,394 | B1 * | 1/2004 | Gevaert | A47C 1/12 | 174/480 |

(Continued)

*Primary Examiner* — Chi Q Nguyen

(74) *Attorney, Agent, or Firm* — James E. Schultz, Jr.

(57) ABSTRACT

A reconfigurable seating system may include a bank of seating units disposed in rows. Associated chairs may be arranged in the seating units, supported on support beams by chair brackets. The reconfigurable seating systems may be installed on flat floors or sloped floors and may be arranged in linear-rows and/or arched-row configurations.

20 Claims, 40 Drawing Sheets

(56) References Cited

U.S. PATENT DOCUMENTS

| | | | | |
|---|---|---|---|---|
| 6,942,295 | B1 * | 9/2005 | Lopez | A47C 1/024<br>267/141.1 |
| 7,303,235 | B1 * | 12/2007 | Fongers | A47C 1/16<br>297/217.7 |
| 8,438,756 | B2 * | 5/2013 | Kelley | A43B 3/12<br>36/100 |
| 2005/0046257 | A1 * | 3/2005 | Pernicka | A47B 83/02<br>297/344.21 |
| 2005/0146180 | A1 * | 7/2005 | Fisher | A47C 1/12<br>297/248 |
| 2005/0168032 | A1 * | 8/2005 | Olarte | A47C 1/121<br>297/331 |
| 2006/0238004 | A1 * | 10/2006 | Conner | A47C 7/54<br>297/216.14 |
| 2008/0217979 | A1 * | 9/2008 | King | A47C 1/121<br>297/338 |
| 2010/0090504 | A1 * | 4/2010 | Brink | A47C 7/70<br>297/162 |
| 2011/0062755 | A1 * | 3/2011 | Gil | A47C 1/12<br>297/232 |
| 2013/0001990 | A1 * | 1/2013 | Maksymowski | A47C 1/124<br>297/248 |
| 2013/0019540 | A1 * | 1/2013 | Magnus | E04H 3/126<br>52/8 |
| 2015/0054330 | A1 * | 2/2015 | Sprinkle | A47C 7/002<br>297/463.1 |
| 2016/0374469 | A1 * | 12/2016 | Ham | A47C 1/12<br>297/248 |

* cited by examiner

RECONFIGURABLE SEATING SYSTEMS

CROSS REFERENCE TO RELATED APPLICATIONS

The present application claims the benefit of priority under 35 U.S.C. §119, to U.S. provisional patent applications Ser. No. 62/006,363, entitled RECONFIGURABLE SEATING SYSTEMS, SEAT ASSEMBLIES FOR USE WITHIN THE RECONFIGURABLE SEATING SYSTEMS, COMPONENTS FOR USE WITHIN THE SEAT ASSEMBLIES AND PARTS FOR USE WITHIN THE COMPONENTS, as filed on Jun. 2, 2014; Ser. No. 62/018,854, entitled BEAM MOUNTED CHAIR ASSEMBLIES, CHAIR ASSEMBLIES FOR USE WITHIN THE BEAM MOUNTED CHAIR ASSEMBLIES, COMPONENTS FOR USE WITHIN THE CHAIR ASSEMBLIES AND PARTS FOR USE WITHIN THE COMPONENTS, as filed on Jun. 30, 2014; Ser. No. 62/143,079, entitled POWERED CHAIRS FOR PUBLIC VENUES, ASSEMBLIES FOR USE IN POWERED CHAIRS, AND COMPONENTS FOR USE IN ASSEMBLIES FOR USE IN POWERED CHAIRS, as filed on Apr. 4, 2015; Ser. No. 62/149,596, entitled POWERED CHAIRS FOR PUBLIC VENUES, ASSEMBLIES FOR USE IN POWERED CHAIRS, AND COMPONENTS FOR USE IN ASSEMBLIES FOR USE IN POWERED CHAIRS, as filed on Apr. 19, 2015; Ser. No. 62/159,791, entitled POWERED CHAIRS FOR PUBLIC VENUES, ASSEMBLIES FOR USE IN POWERED CHAIRS, AND COMPONENTS FOR USE IN ASSEMBLIES FOR USE IN POWERED CHAIRS, as filed on May 11, 2015; the disclosures of which are incorporated herein in their entireties by reference.

The present disclosure relates to commonly assigned provisional patent applications Ser. No. 61/856,013, entitled TELESCOPIC SEATING SYSTEMS, AND FOLDABLE CHAIRS AND RELATED COMPONENTS FOR USE WITHIN TELESCOPIC SEATING SYSTEMS, filed Jul. 18, 2013; Ser. No. 61/868,547, entitled TELESCOPIC SEATING SYSTEMS, AND FOLDABLE CHAIRS AND RELATED COMPONENTS FOR USE WITHIN TELESCOPIC SEATING SYSTEMS, filed Aug. 21, 2013; and Ser. No. 61/946,824, entitled ROCKER STYLE CHAIRS, MODULAR COMPONENTS FOR USE WITHIN ROCKER STYLE CHAIRS AND PARTS FOR USE WITHIN THE MODULAR COMPONENTS, filed Mar. 2, 2014; and U.S. patent applications Ser. No. 14/465,791, entitled TELESCOPIC SEATING SYSTEMS, AND FOLDABLE CHAIRS AND RELATED COMPONENTS FOR USE WITHIN TELESCOPIC SEATING SYSTEMS, filed Aug. 11, 2014; and Ser. No. 14/636,045, entitled ROCKER STYLE CHAIRS, MODULAR COMPONENTS FOR USE WITHIN ROCKER STYLE CHAIRS AND PARTS FOR USE WITHIN THE MODULAR COMPONENTS, filed Mar. 2, 2015, the disclosures of which are incorporated herein in their entireties by reference.

FIELD OF THE INVENTION

The present disclosure relates to reconfigurable seating assemblies. More particularly, the present disclosure relates to reconfigurable seating for auditoriums, cinemas, concert halls, arenas, gymnasiums, theaters and various other venues, and to seat assemblies for use within the reconfigurable seating systems, components for use within the seat assemblies and parts for use within the components.

BACKGROUND OF THE INVENTION

In the past, buildings such as cinemas, theaters, concert halls, arenas and other areas of public entertainment have been provided with seating which is permanently fixed to the floor. Indeed, related building codes require that venues, having more than 200 seats, incorporate anchors that secure the seats in place.

More recently there has been a tendency for such buildings to serve more than one purpose. For example, a building for public entertainment may be required, on one occasion, to serve as a sports hall, and on another occasion to serve as a concert hall or theatre. Similarly, seating arrangements in concert halls, theatres or arenas may need to be reconfigurable to suit the requirements of a particular production being staged.

Tiered seating systems have been devised which, when not in use, can be folded or otherwise collapsed against a wall of the building in which they are situated (e.g. telescopic seating systems such as those disclosed in commonly assigned patent applications Ser. No. 61/856,013, entitled Telescopic Seating Systems, and Foldable Chairs and Related Components for use within Telescopic Seating Systems, filed Jul. 18, 2013 and Ser. No. 61/868,547, entitled Telescopic Seating Systems, and Foldable Chairs and Related Components for use within Telescopic Seating Systems, filed Aug. 21, 2013), thus freeing the floor area for other purposes. However, there has, so far, been no satisfactory solution to the problem of installing reconfigurable seating on a sloped floor.

Seating for an audience in a public building or arena must comply with statutory regulations. These regulations are principally intended to ensure that the building or arena can be evacuated rapidly in the event of an emergency. Thus, there is a minimum spacing which must be observed between adjacent rows of seats, and provision must be made for preventing the rows of seats from moving relatively to one another in a way which would reduce the spacing below this minimum. Also, adjacent seats in a row must be secured together to ensure that they cannot move independently when in use.

One way of meeting the statutory requirements is to secure the seats individually to the floor, but this is unsatisfactory. However, installation and removal of the seats are very time consuming when the individual chairs are secured to the floor. Furthermore, it is not acceptable for the seats to be individually fastened to the floor when the condition of the floor is important, for example if the floor is to be used, on other occasions, as a dance floor or a playing surface for sports.

SUMMARY

A reconfigurable seating system may include at least one seating unit having at least two mounting feet, at least two floor plates, wherein a first one of the at least two floor plates includes at least one first mounting foot receptacle for releasably receiving a first mounting foot of the at least two mounting feet, wherein a second one of the at least two floor plates includes at least one second mounting foot receptacle for releasably receiving a second mounting foot of the at least two mounting feet, and wherein the at least one seating unit is adjustable between a flat floor orientation and a sloped floor orientation, and at least one floor plate attachment, wherein the at least one floor plate attachment is configured to secure the at least one seating unit, to an associated floor, in a predetermined located.

In another embodiment, a reconfigurable seating system may include at least one seating unit having at least two mounting feet, at least two floor plates, wherein a first one of the at least two floor plates includes at least one first mounting foot receptacle for releasably receiving a first mounting foot of the at least two mounting feet, wherein a second one of the at least two floor plates includes at least one second mounting foot receptacle for releasably receiving a second mounting foot of the at least two mounting feet, and wherein the at least one seating unit is pivotally adjustable between a substantially straight row orientation and a curved row orientation, and at least one floor plate attachment, wherein the at least one floor plate attachment is configured to secure the at least one seating unit, to an associated floor, in a predetermined located.

In a further embodiment, a reconfigurable seating system may include a plurality of seating units arranged in at least two rows, at least one floor plate, wherein the at least one floor plate includes at least one first mounting foot receptacle for releasably receiving a first mounting foot of a first seating unit in a first row and a second mounting foot receptacle for releasably receiving a second mounting foot of a second seating unit in a second row, wherein the plurality of seating units adjustable between a flat floor orientation and a sloped floor orientation, and at least one floor plate attachment, wherein the at least one floor plate attachment is configured to secure the at least one seating unit, to an associated floor, in a predetermined located.

BRIEF DESCRIPTION OF THE FIGURES

The figures described below depict various aspects of the systems and methods disclosed herein. It should be understood that each figure depicts an embodiment of a particular aspect of the disclosed systems and methods, and that each of the figures is intended to accord with a possible embodiment thereof. Further, wherever possible, the following description refers to the reference numerals included in the following figures, in which features depicted in multiple figures are designated with consistent reference numerals.

FIG. 1D depicts a top plant view of the example reconfigurable seating system of FIG. 1C;

DETAIL DESCRIPTION

Reconfigurable seating systems are provided having a link system with beam mounted chairs, that may join adjacent chairs within a respective seating unit. A reconfigurable seating system may include: 1) chairs that may be easily reconfigurable on flat or sloped floors; and 2) independent link plates of sufficient thickness (e.g., 1/16" thick, 1/8" thick, 3/16" thick, 1/4" thick, 1/2" thick, or beveled to less than 1/2" thick sides, etc.) and width to restrain the chairs in a predetermined location, and which may have the following advantages, a. do not pose a tripping hazard because of their low profile, b. join the chairs between rows so the chairs cannot be tipped over in a panic situation and pose an egress hazard (fire code violation), c. simple to manufacture, d. allow chairs to be set up into different configurations, e. anchored to a floor if desired, f. accommodate straight or radius row layouts (e.g., may interlock or have multiple locking features to accommodate differing row to row spacing), and g. simple chair attachment to floor plates.

A single fastener, or multiple fasteners, may be used to attach each seating unit standard to a respective floor plate. Alternatively, a "ski boot binding" or other quick connect arrangement may be used to releasably secure each seating unit to a respective floor plate. A mounting foot may be used to secure each seating unit to a floor plate. The mounting foot may be configured to ensure each seating unit is stable during storage and transport, and when not attached to the floor plate. Individual chairs may be joined within a row in a single, double, triple or more chair seating unit.

Figure 1A:
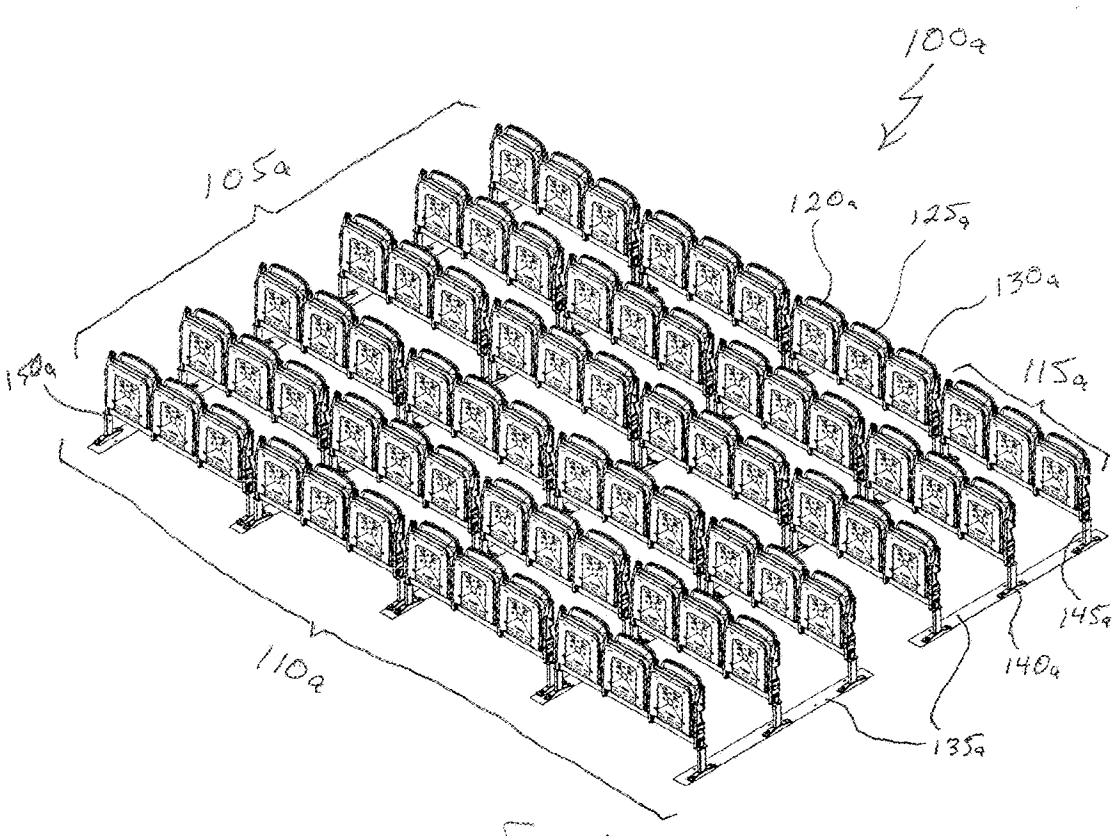
FIG. 1A depicts a top, front, perspective view of an example reconfigurable seating system having foldable chairs in a closed position.

With reference to FIG. 1A a top, front, perspective view of an example reconfigurable seating system 100*a* having foldable chairs 125*a*, 130*a*, 135*a* in a closed position is depicted. The reconfigurable seating system 100*a* may include rows 105*a* of seating units 115*a* arranged in columns 110*a*. Each seating unit 115*a* may be mounted include a standard 145*a*, 150*a* with a mounting foot 140*a* releasably connected to a floor plate 135*a*.

Figure 1B:
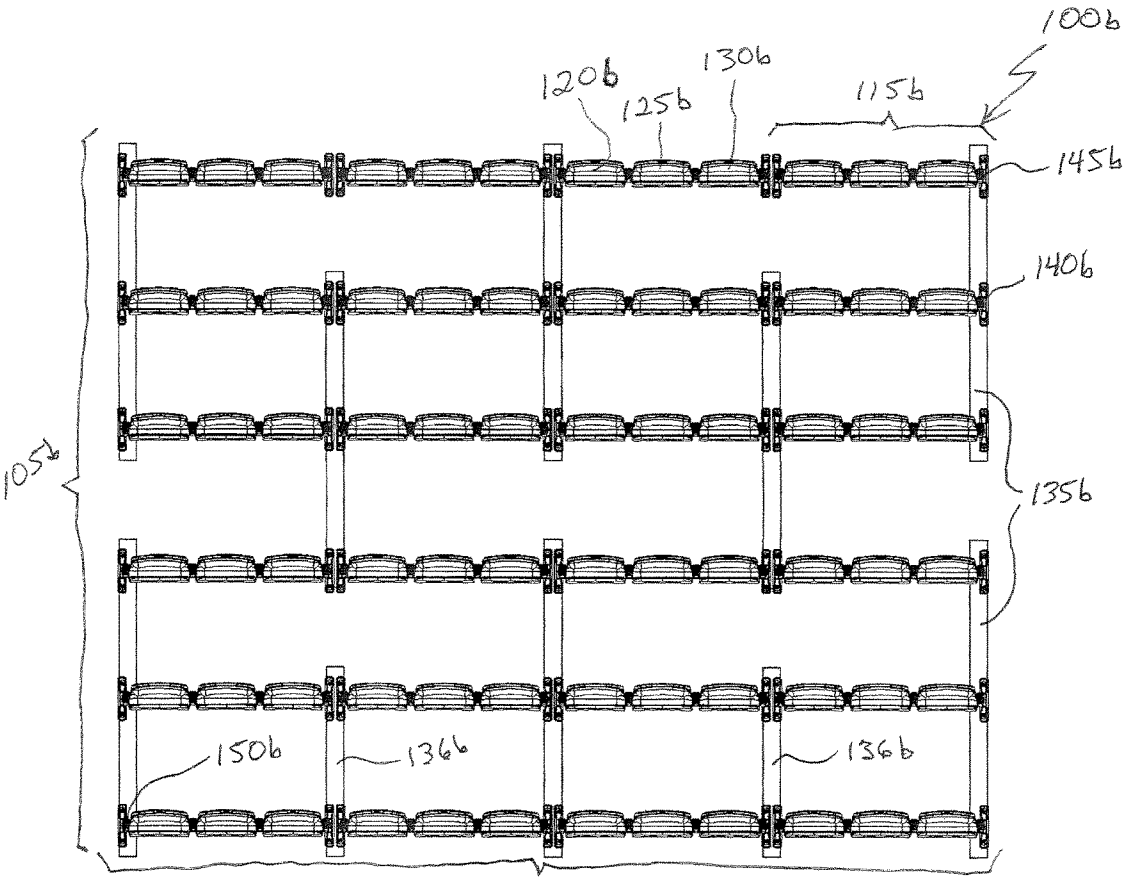
FIG. 1B depicts a top plan view of the example reconfigurable seating system of FIG. 1A.

Turning to FIG. 1B a top plan view of an example reconfigurable seating system 100*b* is depicted. The reconfigurable seating system 100*b* may be similar to the reconfigurable seating system 100*a* of FIG. 1A. The reconfigurable seating system 100*b* may include rows 105*b* of seating units 115*b* arranged in columns 110*b*. Each seating unit 115*b* may be mounted include a standard 145*b*, 150*b* with a mounting foot 140*b* releasably connected to a floor plate 135*b*, 136*b*.

Figure 1C:
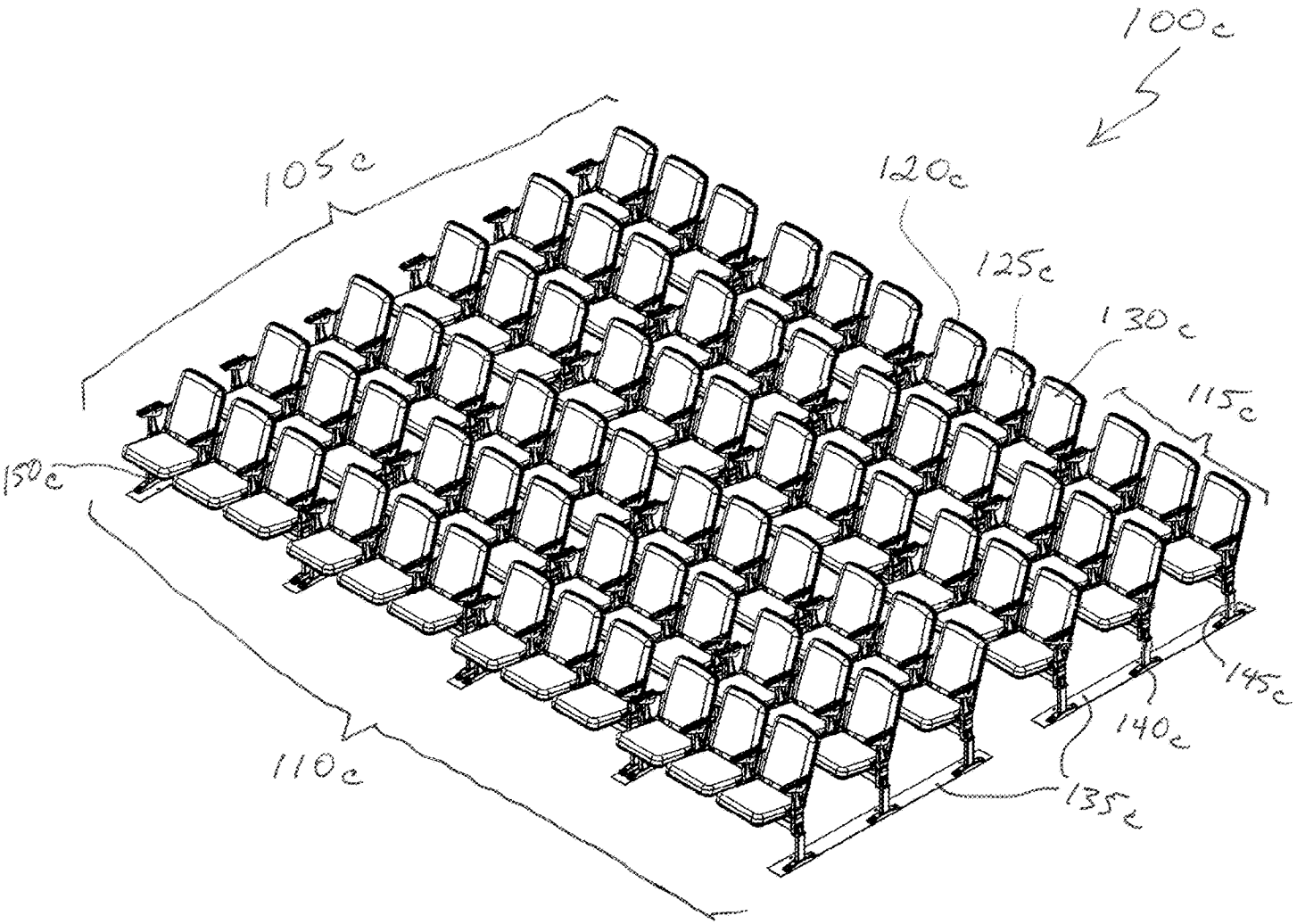
FIG. 1C depicts a top perspective view of the example reconfigurable seating system of FIG. 1A having the foldable chairs in an open position.

With reference to FIG. 1C a top perspective view of an example reconfigurable seating system 100*c* is depicted. The reconfigurable seating system 100*c* may be similar to the reconfigurable seating system 100*a* of FIG. 1A. The reconfigurable seating system 100*c* may include rows 105*c* of seating units 115*c* arranged in columns 110*c*. Each seating unit 115*c* may be mounted include a standard 145*c*, 150*c* with a mounting foot 140*c* releasably connected to a floor plate 135*c*.

Turning to FIG. 1D a top plant view of an example reconfigurable seating system 100*d* is depicted. The reconfigurable seating system 100*d* may be similar to the reconfigurable seating system 100*c* of FIG. 1C. The reconfigurable seating system may include rows 105*d* of seating units 115*d* arranged in columns 110*d*. Each seating unit 115*d* may be mounted include a standard 145*d*, 150*d* with a mounting foot 140*d* releasably connected to a floor plate 135*d*.

Figure 1E:
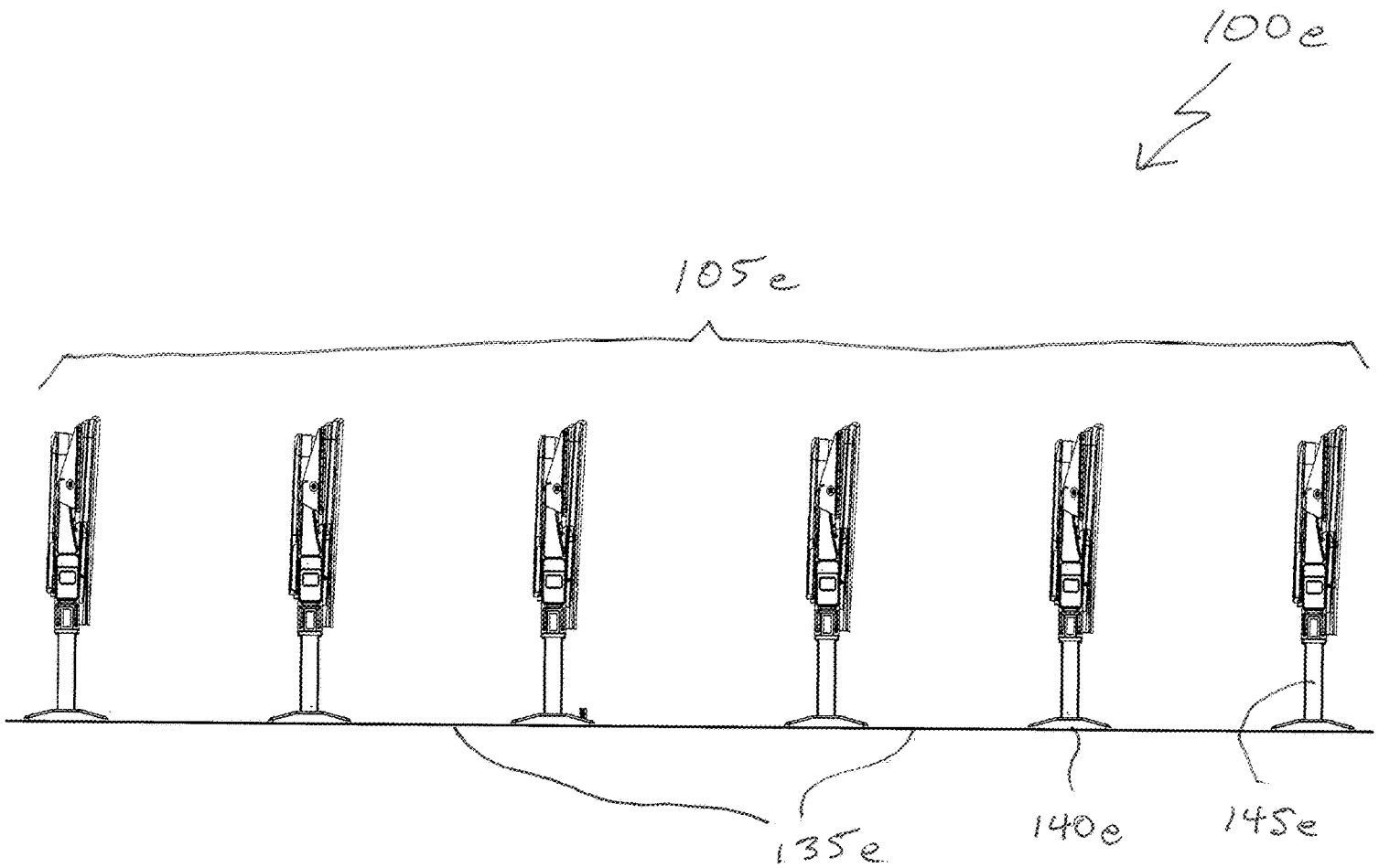
FIG. 1E depicts a left-side profile view of the example reconfigurable seating system of FIG. 1A.

With reference to FIG. 1E a left-side profile view of an example reconfigurable seating system 100*e* is depicted. The reconfigurable seating system 100*e* may be similar to the reconfigurable seating system 100*a* of FIG. 1A. The reconfigurable seating system 100*e* may include rows 105*a* of seating units. Each seating unit may include a standard 145*e* with a mounting foot 140*e* releasably connected to a floor plate 135*e*.

Figure 1F:
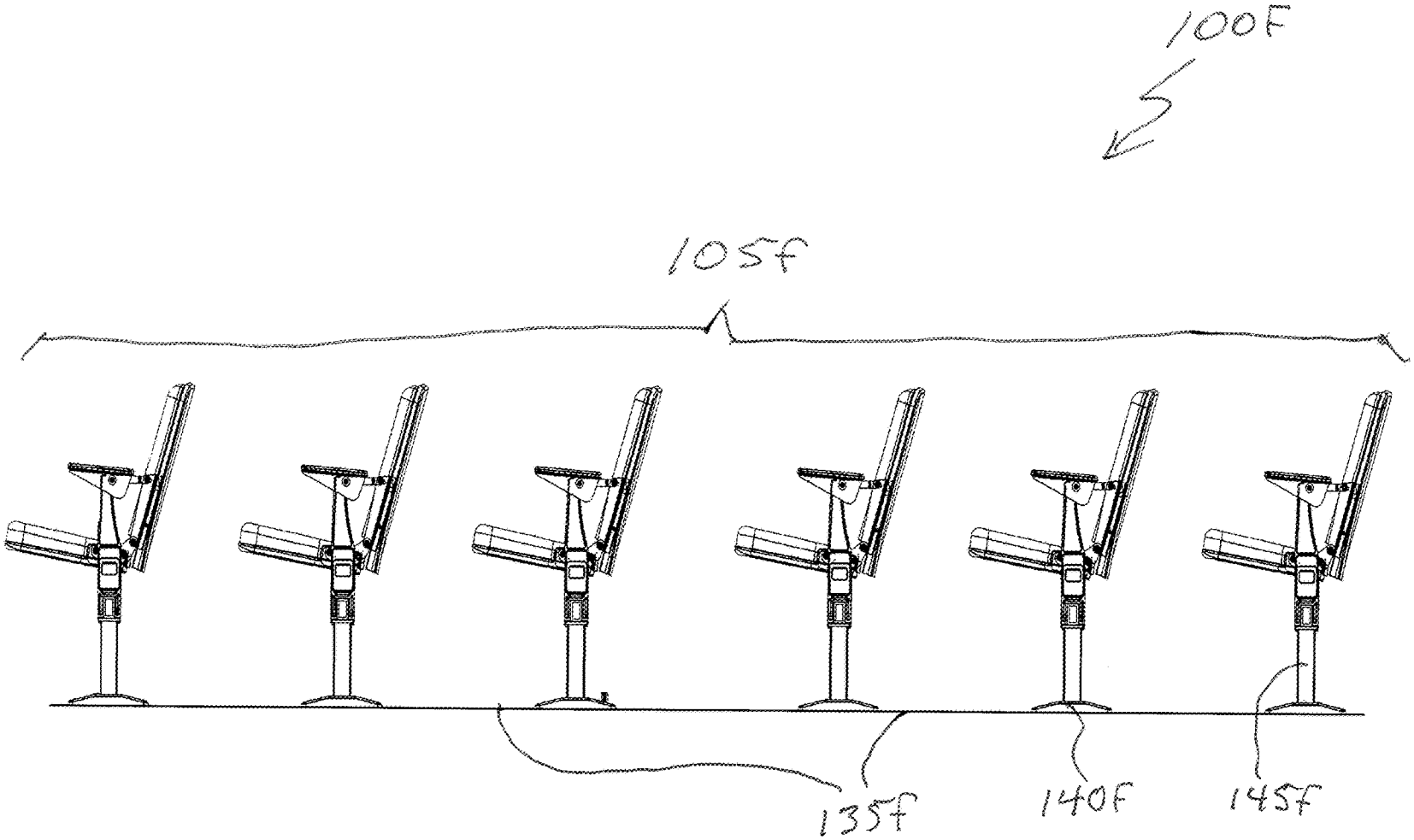
FIG. 1F depicts a left-side profile view of the example reconfigurable seating system of FIG. 1C.

Turning to FIG. 1F a left-side profile view of an example reconfigurable seating system 100*f* is depicted. The reconfigurable seating system 100*f* may be similar to the reconfigurable seating system 100*c* of FIG. 1C. The reconfigurable seating system 100*f* may include rows 105*a* of seating units 115*a*. Each seating unit may include a standard 145*f* with a mounting foot 140*f* releasably connected to a floor plate 135*f*.

Figure 1G:
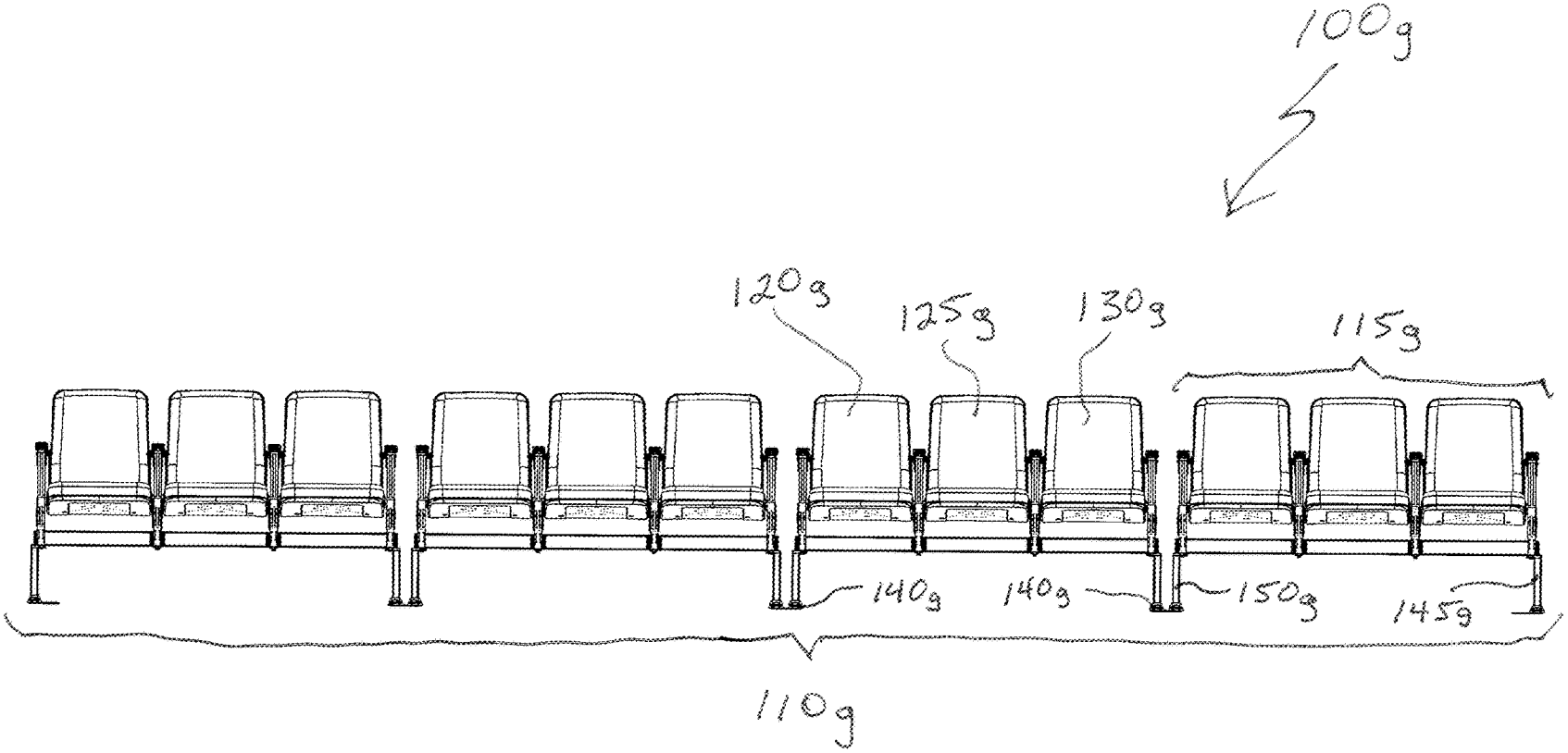
FIG. 1G depicts a front profile view of the example reconfigurable seating system of FIG. 1C.

With reference to FIG. 1G a front profile view of an example reconfigurable seating system 100*g* is depicted. The reconfigurable seating system 100*g* may be similar to the reconfigurable seating system 100*c* of FIG. 1C. The reconfigurable seating system 100*g* may include columns 110*g* of seating units 115*g* having a plurality of chairs 120*g*, 125*g*, 130*g*. Each seating unit 115*g* may include a standard 145*g*, 150*g* with a respective mounting foot 140*g* releasably connected to a floor plate.

Figure 1H:
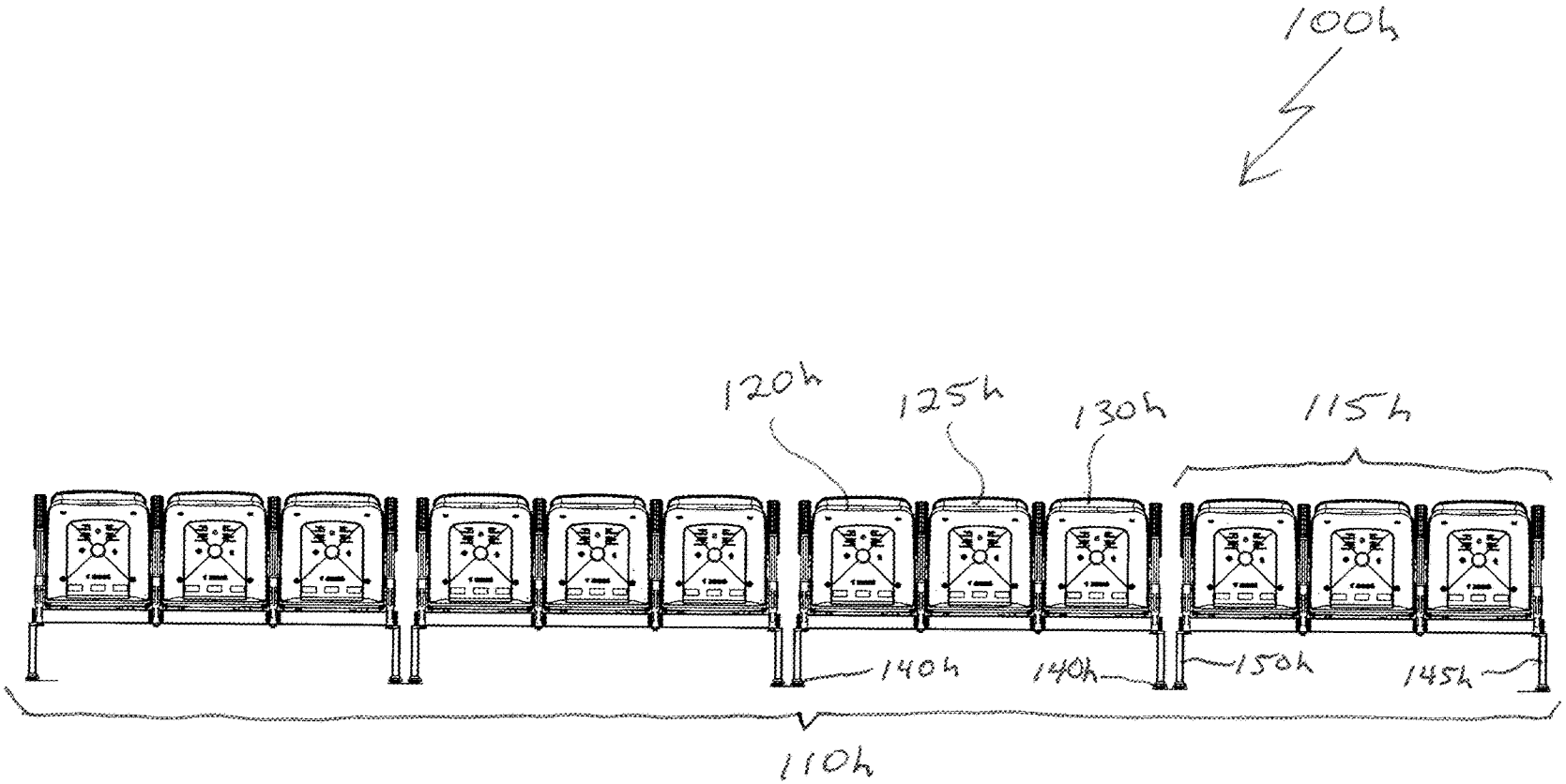
FIG. 1H depicts a front profile view of the example reconfigurable seating system of FIG. 1A.

With reference to FIG. 1H a front profile view of an example reconfigurable seating system 100*h* is depicted. The reconfigurable seating system 100*h* may be similar to the reconfigurable seating system 100*a* of FIG. 1A. The reconfigurable seating system 100*h* may include columns 110*h* of seating units 115*h* having a plurality of chairs 120*h*, 125*h*, 130*h*. Each seating unit 115*h* may include a standard 145*h*, 150*h* with a respective mounting foot 140*h* releasably connected to a floor plate.

Figure 1J:
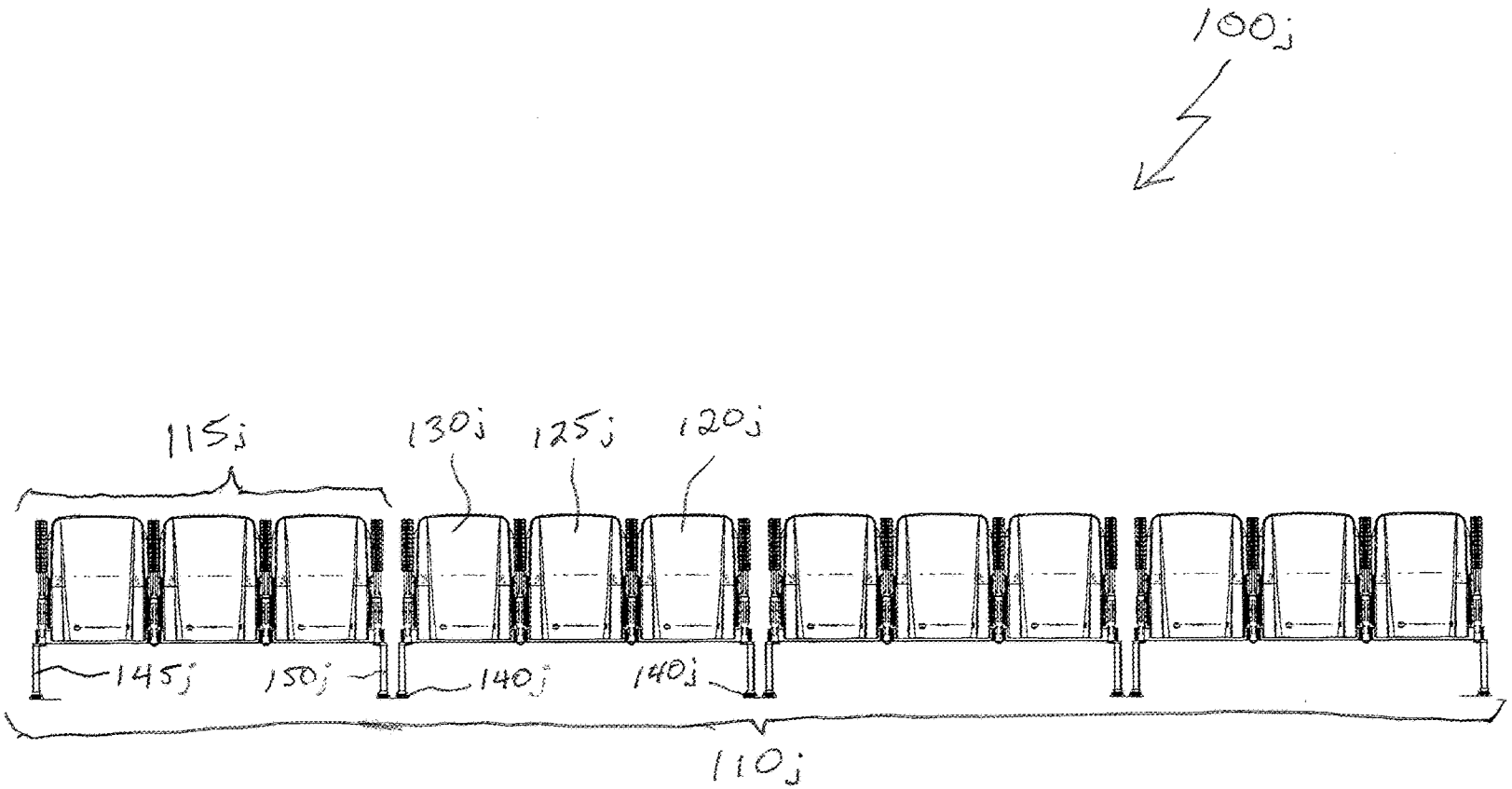
FIG. 1J depicts a rear profile view of the example reconfigurable seating system of FIG. 1A.

With reference to FIG. 1J a front profile view of an example reconfigurable seating system 100*j* is depicted. The reconfigurable seating system 100*j* may be similar to the reconfigurable seating system 100*a* of FIG. 1A. The reconfigurable seating system 100*j* may include columns 110*j* of seating units 115*j* having a plurality of chairs 120*j*, 125*j*, 130*j*. Each seating unit 115*j* may include a standard 145*j*, 150*j* with a respective mounting foot 140*j* releasably connected to a floor plate.

Figure 2:
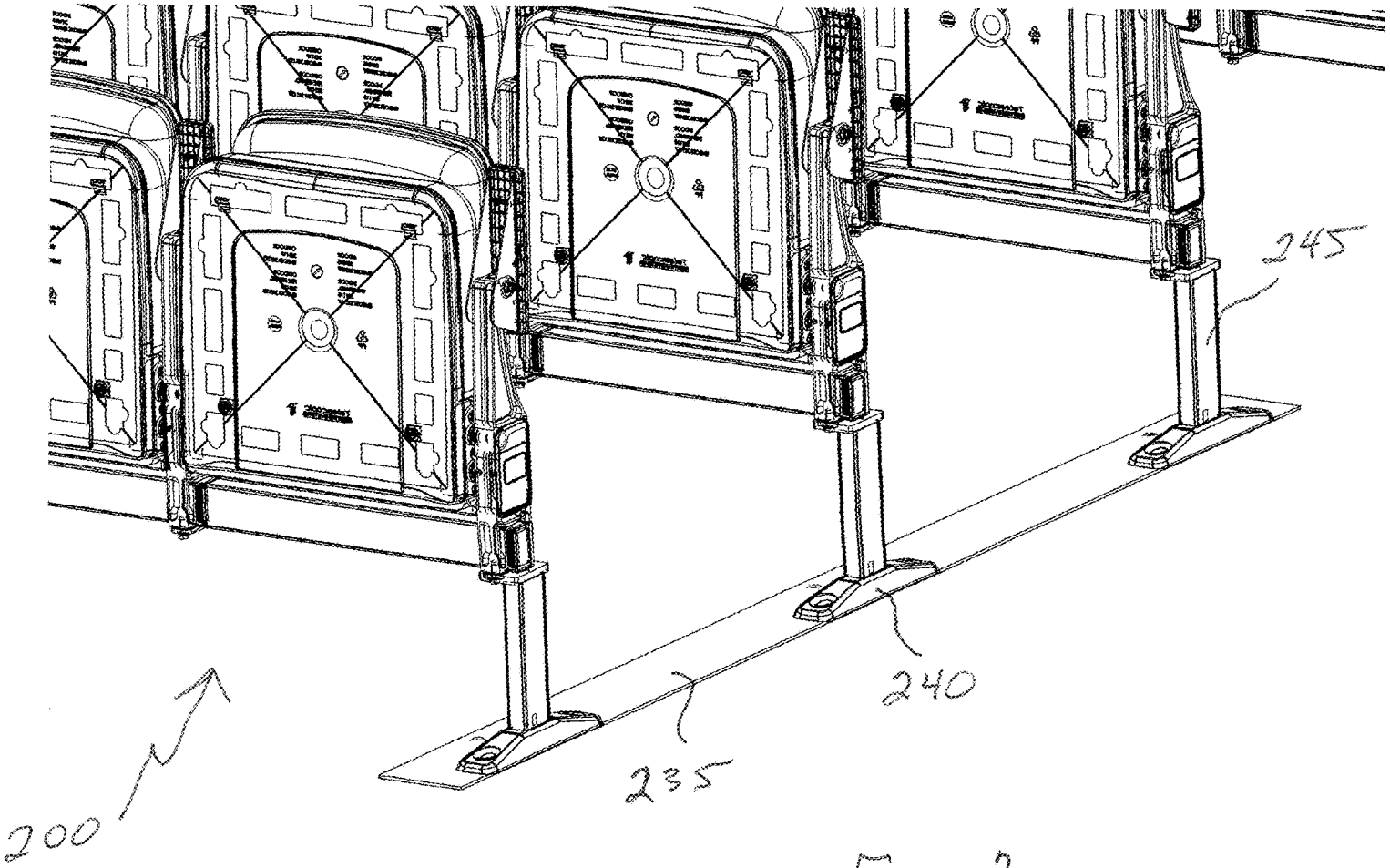
FIG. 2 depicts a top, front, perspective view of a portion of the chairs within the example reconfigurable seating system of FIGS. 1A-H and J and FIGS. 13A-D.

Turning to FIG. 2 a top, front, perspective view of a portion of the chairs 200. Each chair 200 may be similar to the chairs 120*a*, 125*a*, 130*a* within the example reconfigurable seating system 100*a-j* and 1300*a-d* of FIGS. 1A-H and J and FIGS. 13A-D is depicted. Associated seating units may include standard 245 with a mounting foot 240 releasably secured to a floor plate 235.

Figure 3:
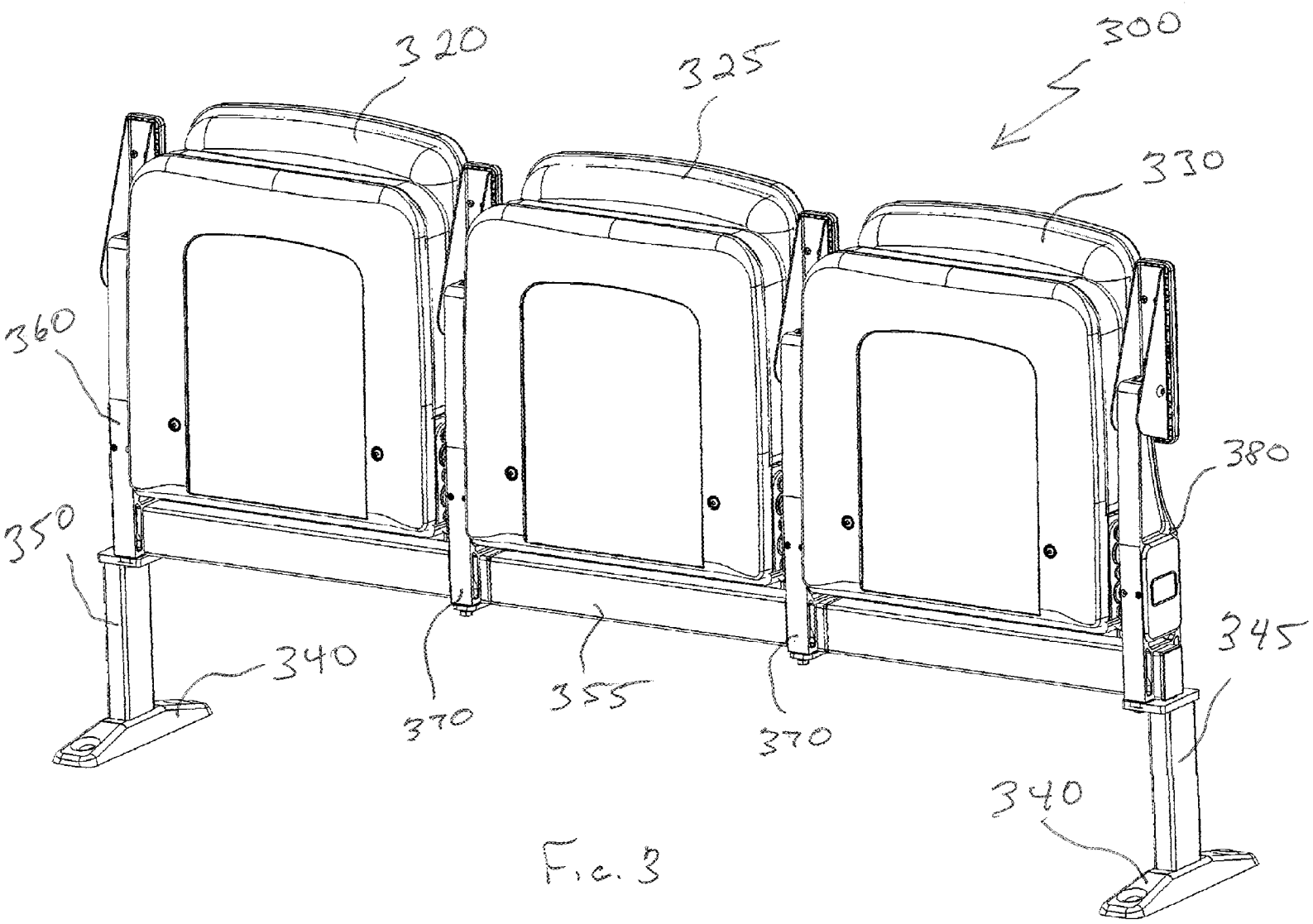
FIG. 3 depicts a top, front perspective view of an example seating unit for use within the example reconfigurable seating system of FIGS. 1A-H and J and FIGS. 13A-D.

With reference to FIG. 3 a top, front perspective view of an example seating unit 300 for use within the example reconfigurable seating systems 100*a-j* and 1300*a-d* of FIGS. 1A-H and J and FIGS. 13A-D is depicted. The seating unit 300 may include three chairs 320, 325, 330. While the seating unit 300 is depicted as having three chairs, it should be understood that any given seating unit 300 may include one, two, three, four, five or more chairs. Any one of the chairs 320, 325, 330 may be similar to the chairs as described in the commonly assigned applications that are incorporated herein by reference above. In any event, the seating unit 300 may include a right-end seat bracket 360, two center seat bracket 370 and a left-end seat bracket secured to a support beam 355. The support beam 355 may be secured to a first standard 345 having a first mounting foot 340 and to a second standard 350 having a second mounting foot 340.

Figure 4:
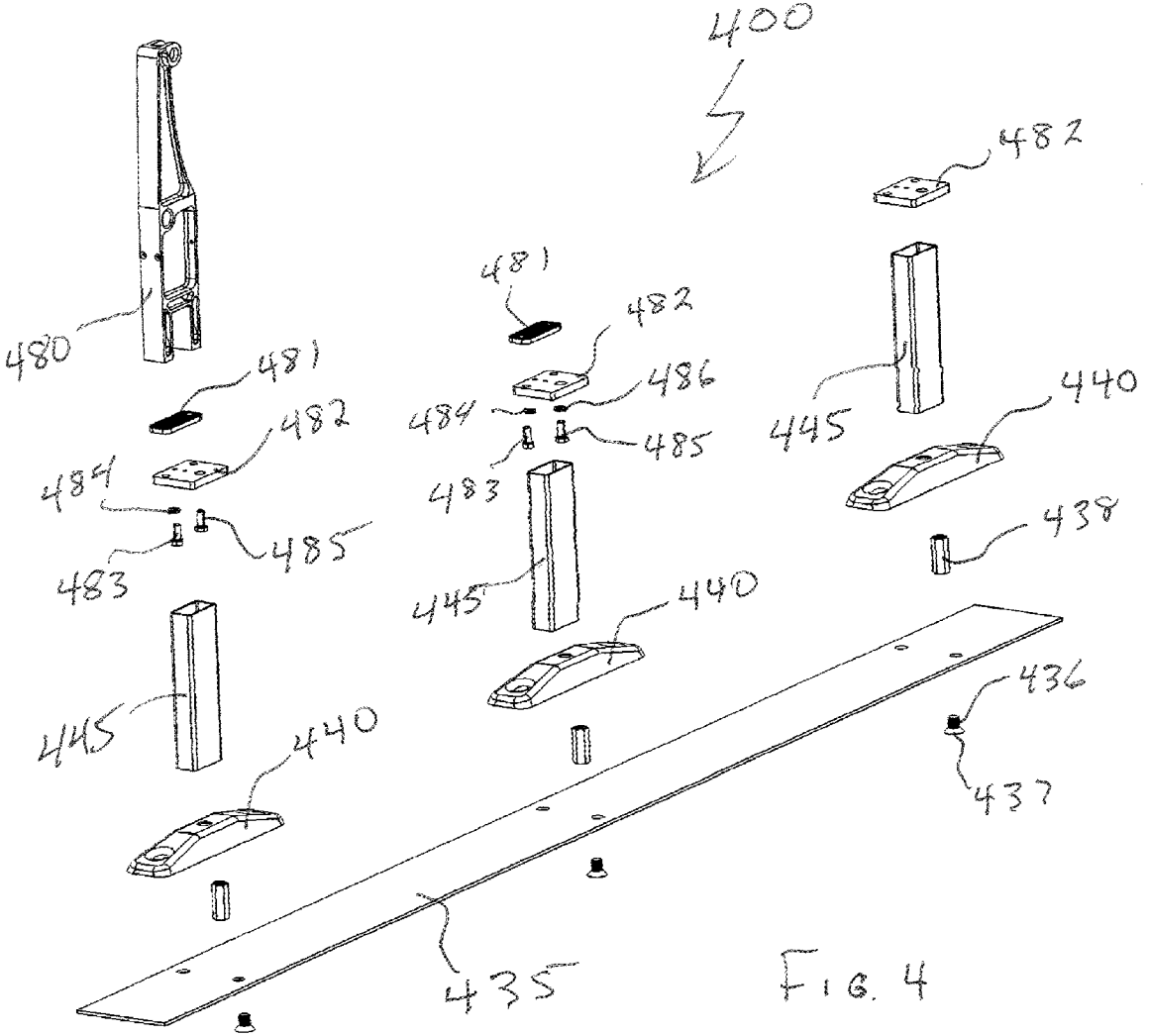
FIG. 4 depicts a top, front, exploded perspective view of a portion of the example reconfigurable seating system of FIGS. 1A-H and J and FIGS. 13A-D.

Turning to FIG. 4 a top, front, exploded perspective view of a portion of an example reconfigurable seating system 400 is depicted. The portion of the reconfigurable seating system 400 may be similar to any portion of the reconfigurable seating systems 100*a-j* and 1300*a-d* of FIGS. 1A-H and J and FIGS. 13A-D. The portion of the reconfigurable seating system 400 may include mounting foot receptacles 438 secured to a floor plate 435 using tapered head 437 bolts 436. Alternately the mounting foot receptacles may be otherwise attached to the floor plate 435 by welding or other means or the receptacle may be an integral part of the floor plate. The portion of the reconfigurable seating system 400 may further include a seat bracket 480 supported by a standard 445 and a mounting foot 440. A bushing 481 and a top plate 482 may be secured between the seat bracket 480 and the standard 445 by a first bolt 483, a first washer 484, second bolt 485 and a second washer 486.

Figures 5A, 5B, 5C:
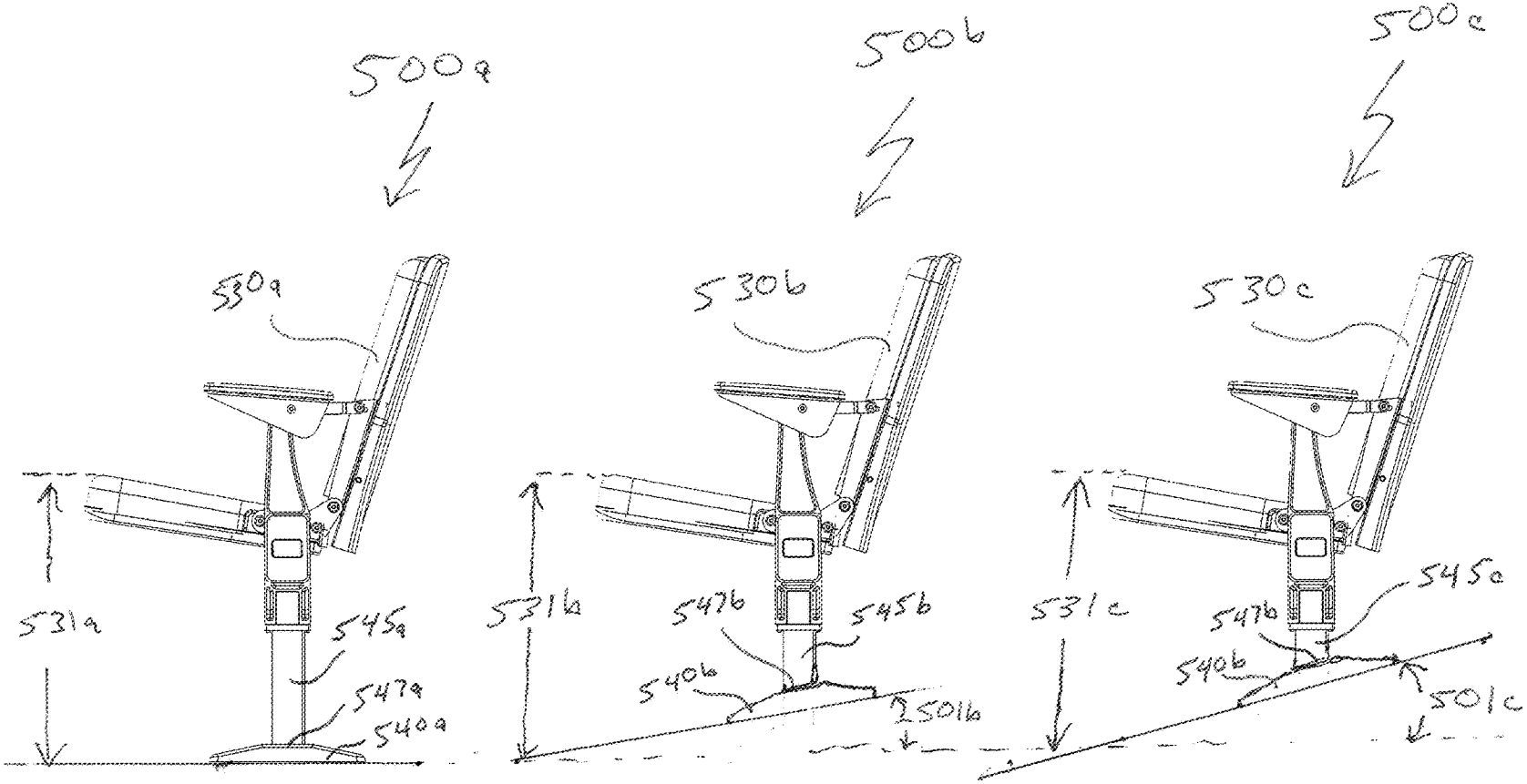
FIGS. 5A-C depict example chairs for use within the example reconfigurable seating system of FIGS. 1A-H and J and FIGS. 13A-D for use with flat to increasing sloped floors.

With reference to FIGS. 5A-C example chairs 530*a*, 530*b*, 530*c* for use within a respective example reconfigurable seating system 500*a*, 500*b*, 500*c* are depicted. The reconfigurable seating systems 500*a*, 500*b*, 500*c* may be similar to the reconfigurable seating systems 100*a-j* or 1300*a-d* of FIGS. 1A-H and J and FIGS. 13A-D. The chair 530*a* may be for use in a reconfigurable seating system to be installed on a flat floor. The chair 530*a* may include a standard 545*a* secured substantially parallel to a mounting foot 547*a* such that the chair seat is located a distance 531*a* from the floor.

The chair 530*b* may be for use in a reconfigurable seating system to be installed on a slightly sloped floor (e.g., a class A or B slope). The chair 530*b* may include a standard 545*b* secured to a mounting foot 547*b* at an angle 501*b* (e.g., 1 to 10 degree angle) approximately equal to the slightly slope of the floor such that the chair seat is located a distance 531*b* from the floor. The standard 545*b* may be shorter than the standard 545*a* such that the distance 531*b* is substantially equal to the distance 531*a*.

The chair 530*c* may be for use in a reconfigurable seating system to be installed on a moderately sloped floor (e.g., a class C or D slope). The chair 530*c* may include a standard 545*c* secured to a mounting foot 547*c* at an angle 501*c* (e.g., 10 to 20 degree angle) approximately equal to the slope of the moderately sloped floor such that the chair seat is located a distance 531*c* from the floor. The standard 545*c* may be shorter than the standard 545*a*, 545*b* such that the distance 531*c* is substantially equal to the distance 531*a*, 531*b*.

While the chairs 530*a*, 530*b*, 530*c* are described with regard to a flat floor, a slightly sloped floor, and a moderately sloped floor, respectively, any one of the chairs 530*a*, 530*b*, 530*c* may be configured to be adjustably installed on any flat or sloped floor. Furthermore, a sloped floor may be any angle, including being negatively sloped with respect to an associated stage.

Figure 6A:
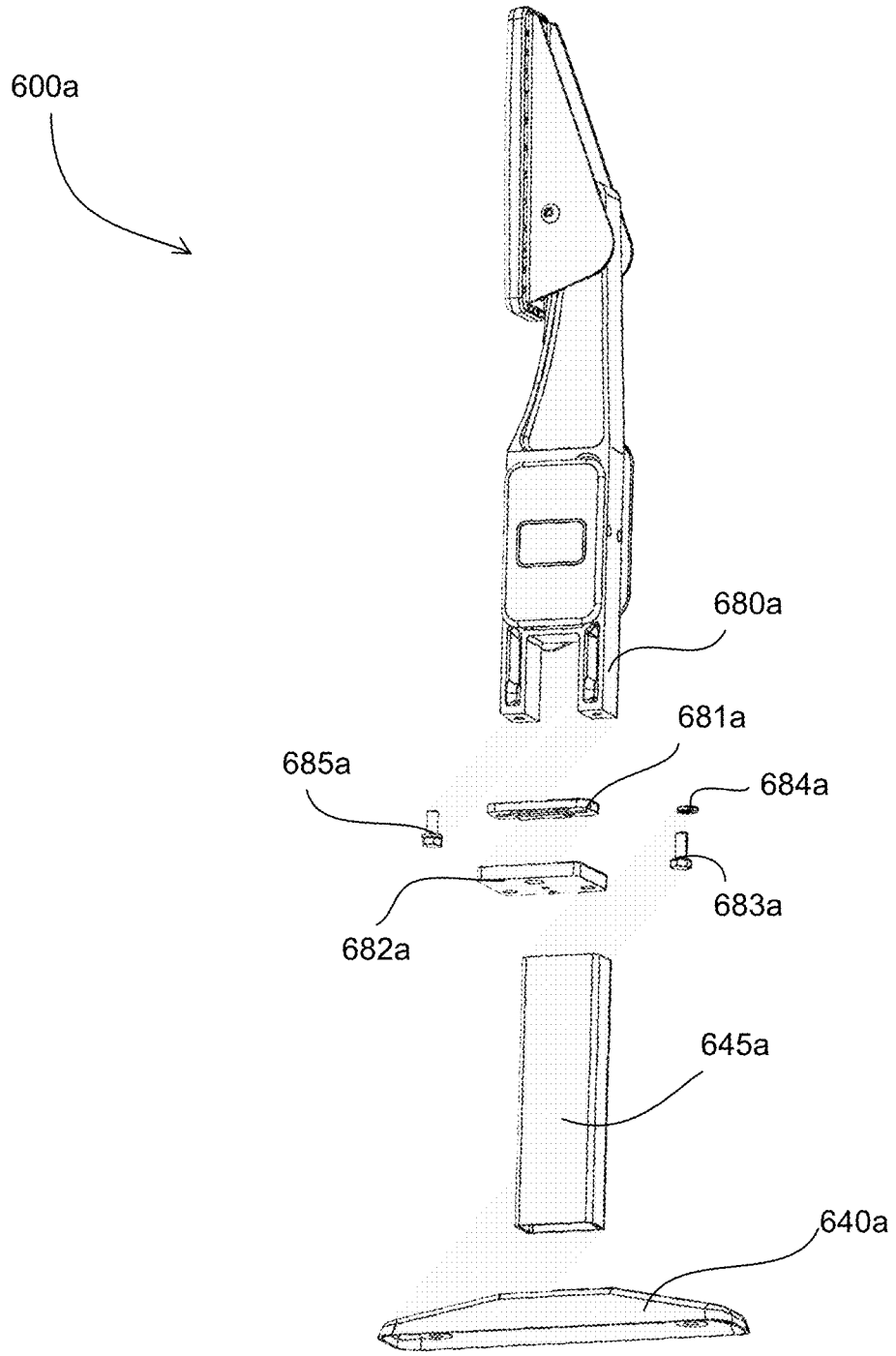
FIGS. 6A-6C depict various views of an example structures for use within the reconfigurable seating system of FIGS. 1A-H and J and FIGS. 13A-D.
Figure 6B:
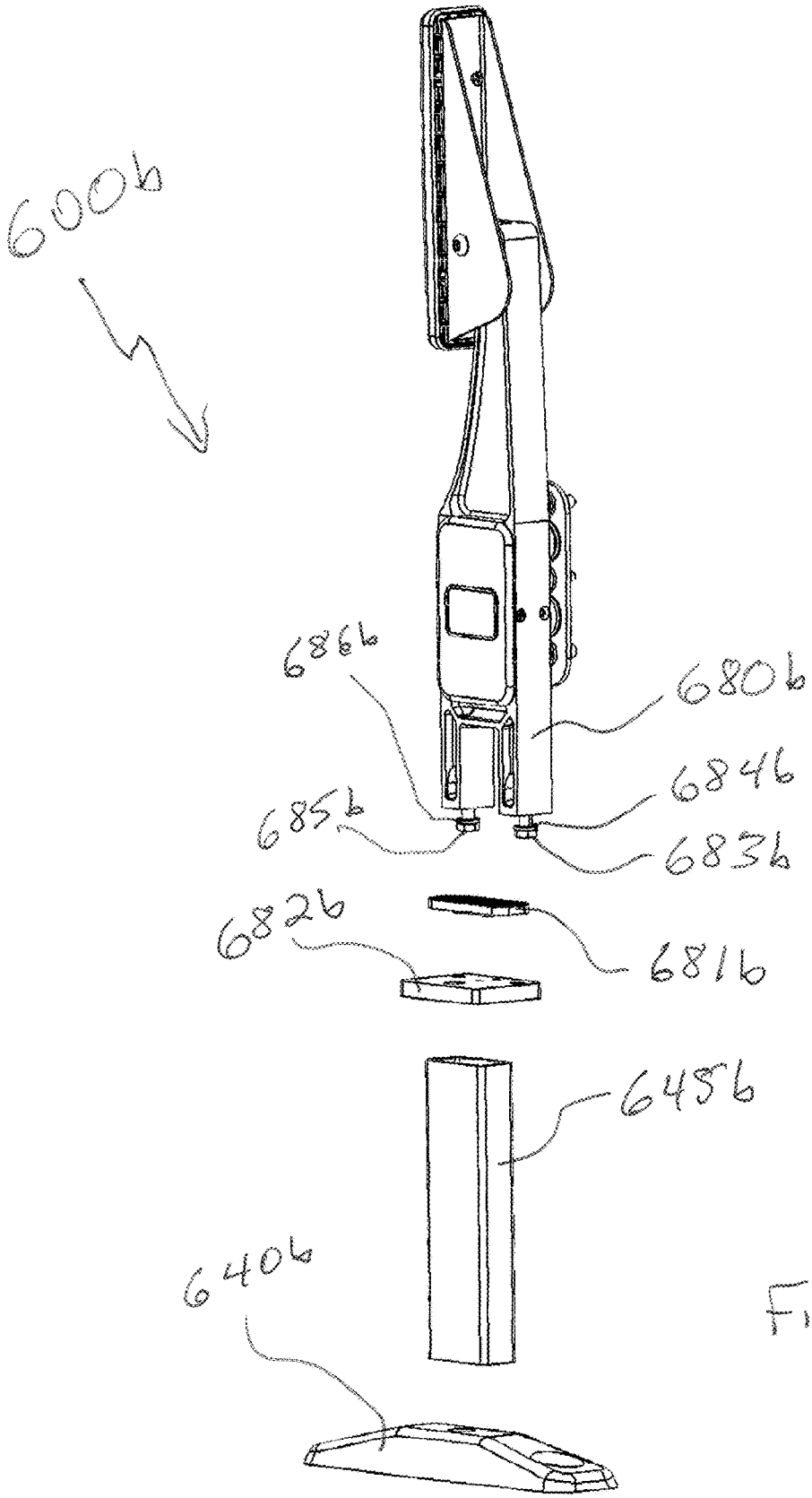
Figure 6C:
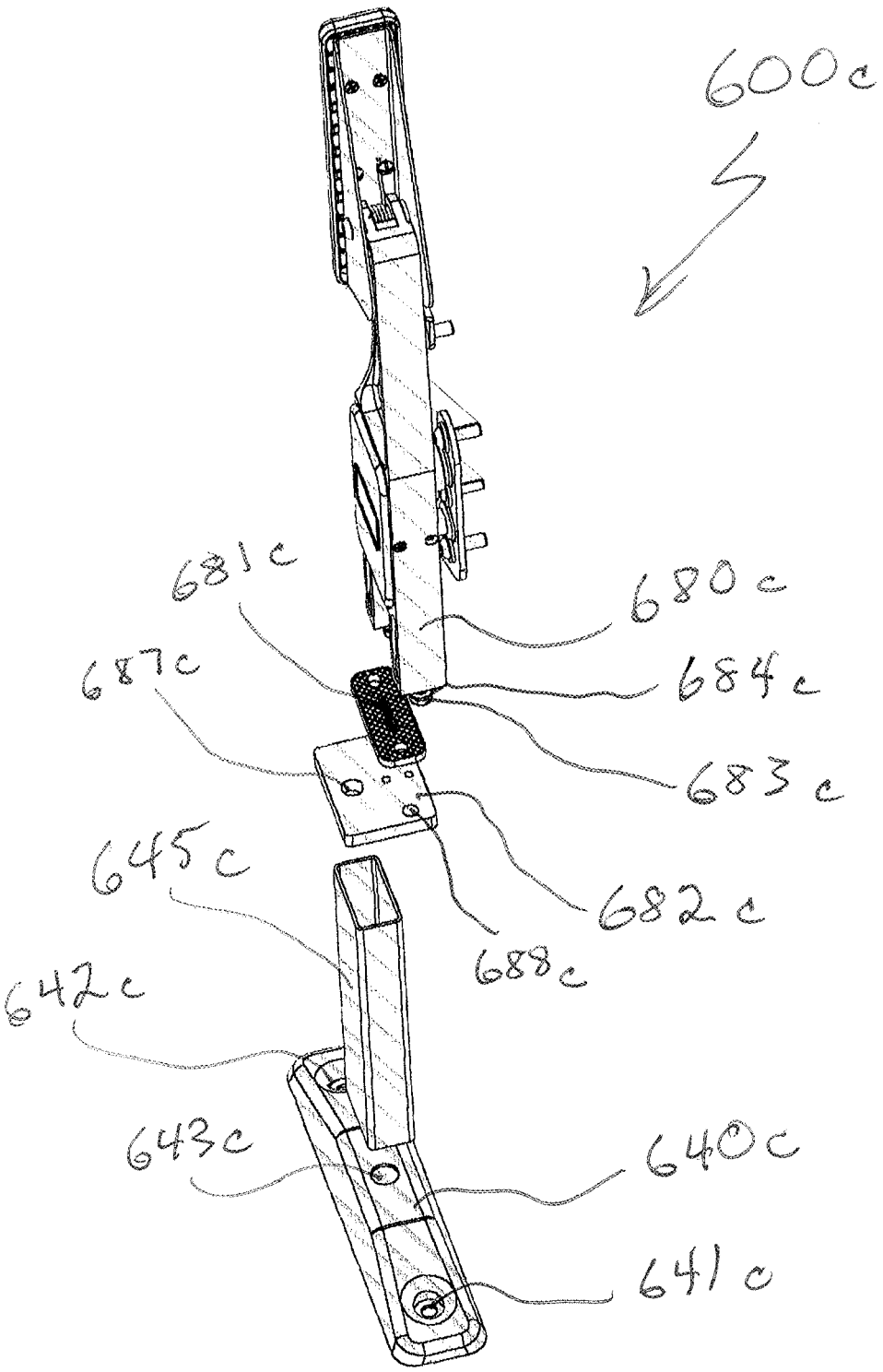

Turning to FIGS. 6A-6C various views of an example structures 600*a*, 600*b*, 600*c*, for use within the reconfigurable seating system 100*a-j* or 1300*a-d* of FIGS. 1A-H and J and FIGS. 13A-D, are depicted. The structure 600*a* may include a top plate 682*a* and a bushing 681*a* secured to a seat bracket 680*a* by a first bolt 683*a*, a first washer 684*a* and a second bolt 685*a*, and supported by a standard 645*a* and a mounting foot 640*a*. The structure 600*b* may include a top plate 682*b* and a bushing 681*b* secured to a seat bracket 680*b* by a first bolt 683*b*, a first washer 684*b*, a second bolt 685*b* and a second washer 686*b*, and supported by a standard 645*b* and a mounting foot 640*b*. The structure 600*c* may include a top plate 682*c* and a bushing 681*c* secured to a seat bracket 680*c* by a first bolt 683*c*, a first washer 684*c*, a second bolt and a second washer, and supported by a standard 645*c* and a mounting foot 640*c*. The mounting foot 640*c* may include a mounting foot receptacle hole 643*c*, a first bolt hole 641*c* and a second bolt hole 642*c*. The function of bracket 681*c* may be incorporated into bracket 682*c*. Bracket 682*c* may also incorporate features to lock it to a seat assembly beam and cooperate with fasteners.

Figure 7:
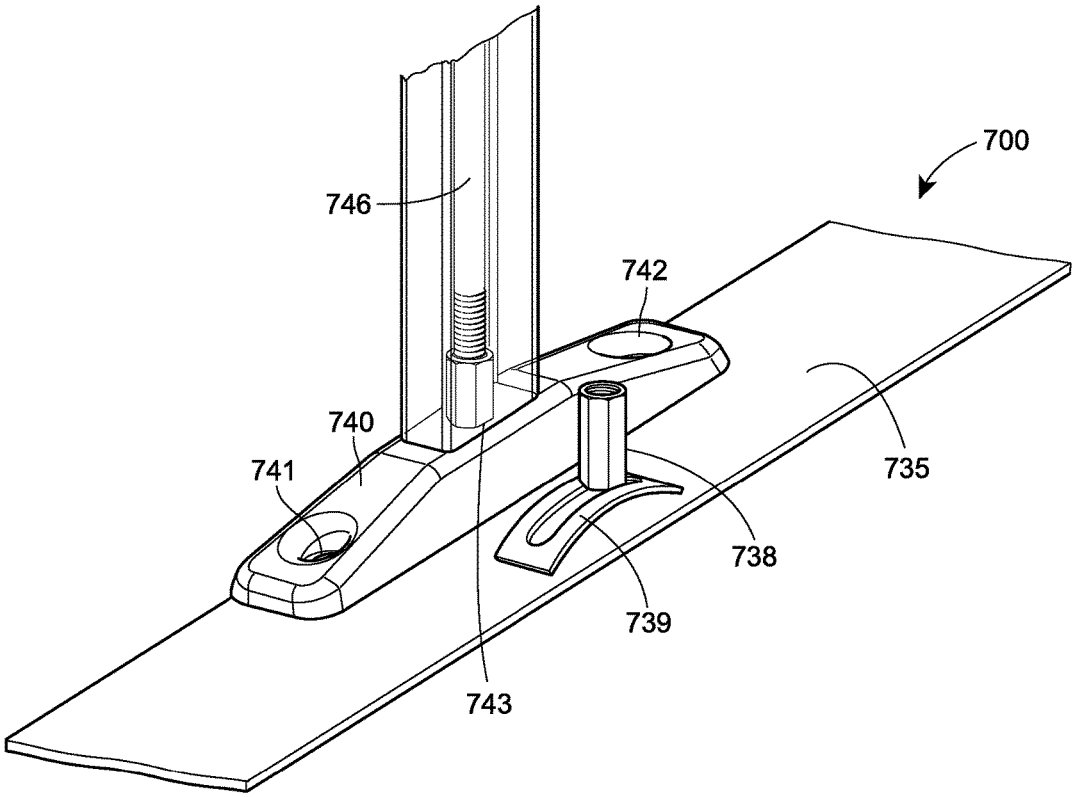
FIG. 7 depicts a portion of an example mounting configuration for mounting two seating units to a common floor plate for use in the reconfigurable seating systems of FIGS. 1A-H and J and FIGS. 13A-D.

With reference to FIG. 7 a portion of an example mounting configuration 700 for mounting two seating units to a common floor plate 735 for use in reconfigurable seating systems 100*a-h* and *j* and 1300*a-d* of FIGS. 1A-H and J and FIGS. 13A-D. The mounting configuration 700 may include mounting foot receptacle 738 pivotally attached to a floor plate pivot bracket 739. The mounting configuration 700 may further include a standard securing bolt 746 engaged securing a mounting foot 740 to the floor plate 735 via a standard/mounting foot intersection 743. The mounting foot 740 may include a first bolt hole 741 and a second bolt hole 742. Individual components of the example mounting configurations 700 may cooperate to adjust for different floor slopes.

Figure 8:
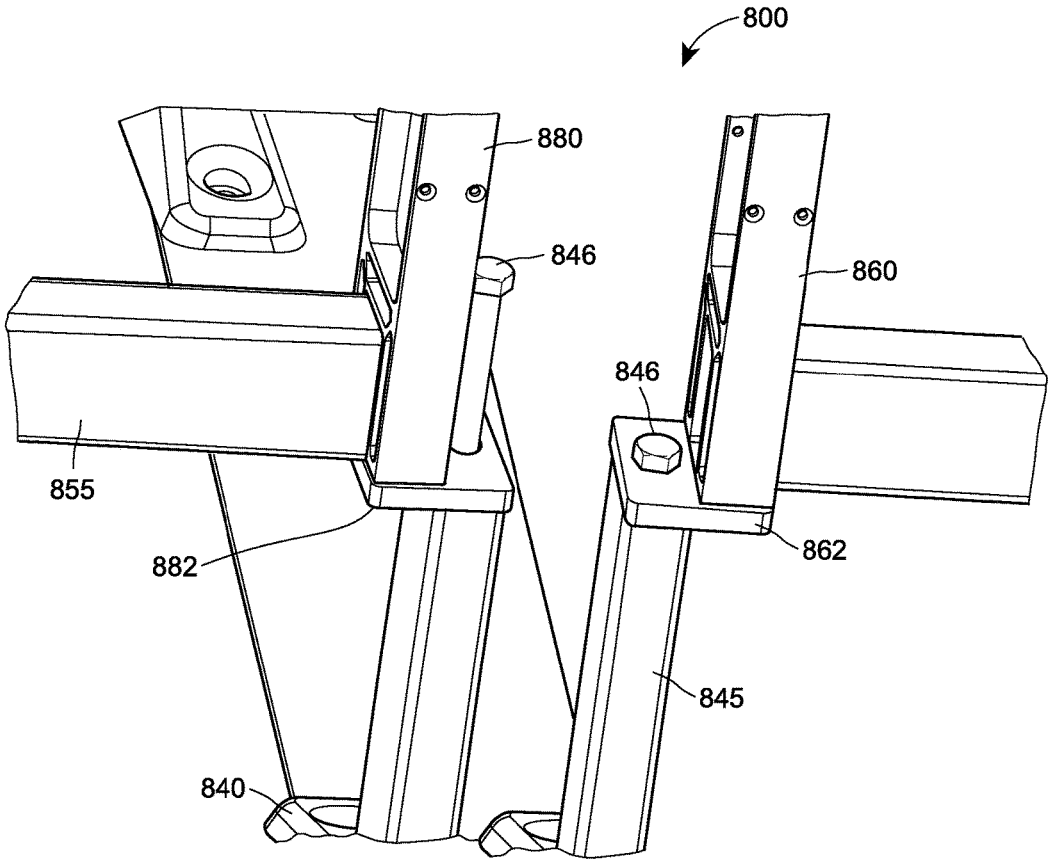
FIG. 8 depicts a portion of an example standard for supporting two seating units on a common floor plate for use within the reconfigurable seating system of FIGS. 1A-H and J and FIGS. 13A-D.

Turning to FIG. 8 a portion 800 of example standards 845 for supporting two seating units on a common floor plate for use within a reconfigurable seating system 100*a-h* and *j* or 13*a-d* of FIGS. 1A-H and J and FIGS. 13A-D is depicted. The portion 800 may include a right-hand chair bracket 860, a left-hand chair bracket 880, a support beam 855, a mounting foot 840, top plates 862, 882 and standard securing bolts 846. The portion 800 illustrates, for example, how adjacent seating units are not required to be co-linear do to the cooperation between the seating units and the floor plates. While the foot on the seating unit is illustrated for convenience at right angles to the seating unit the invention includes variation in the mounting foot angle. While the securing bolt 846 is shown in FIG. 8 as going inside the leg of the foot and being of sufficient length to reach to the top of the plate, any given securing bolt 846 may be external to the foot. Any given securing bolt 846 may be either longer or shorter, and the mounting foot may include alternate materials, such as a casting having alignment features, fastener retaining features or other features to aid in assembly of the associated reconfigurable seating system.

Figure 9:
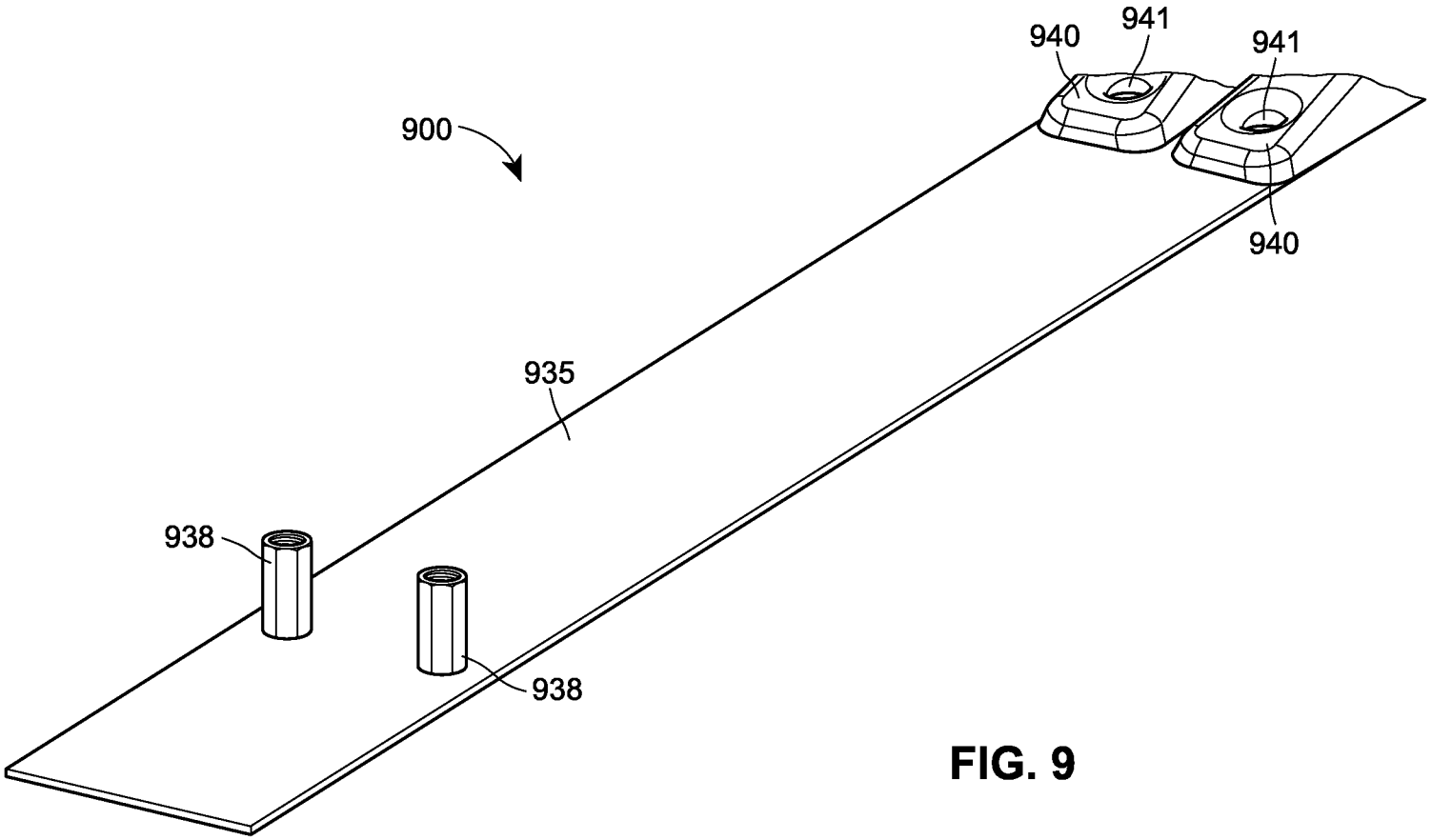
FIG. 9 depicts a portion of an example floor plate with side-by-side mounting feet for use within the reconfigurable seating system of FIGS. 1A-H and J and FIGS. 13A-D.

With reference to FIG. 9 a portion 900 of an example floor plate 935 with side-by-side mounting feet 940 for use within reconfigurable seating systems 100*a-h* and *j* or 13*a-d* of FIGS. 1A-H and J and FIGS. 13A-D is depicted. The portion 900 may include mounting foot receptacles 938 and the mounting feet may include a respective first bolt hole 941. While the mounting foot receptacle 938 is shown by convenience as a what is commonly called a coupling nut, the mounting foot receptacle 938 may be replaced by a unit which aids in foot location, aids in alignment of an associated fastening system, reduces time to fasten (e.g., ¼-turn fasteners), and/or automatically accommodates variation in floor slope and/or relative seat position.

Figure 10:
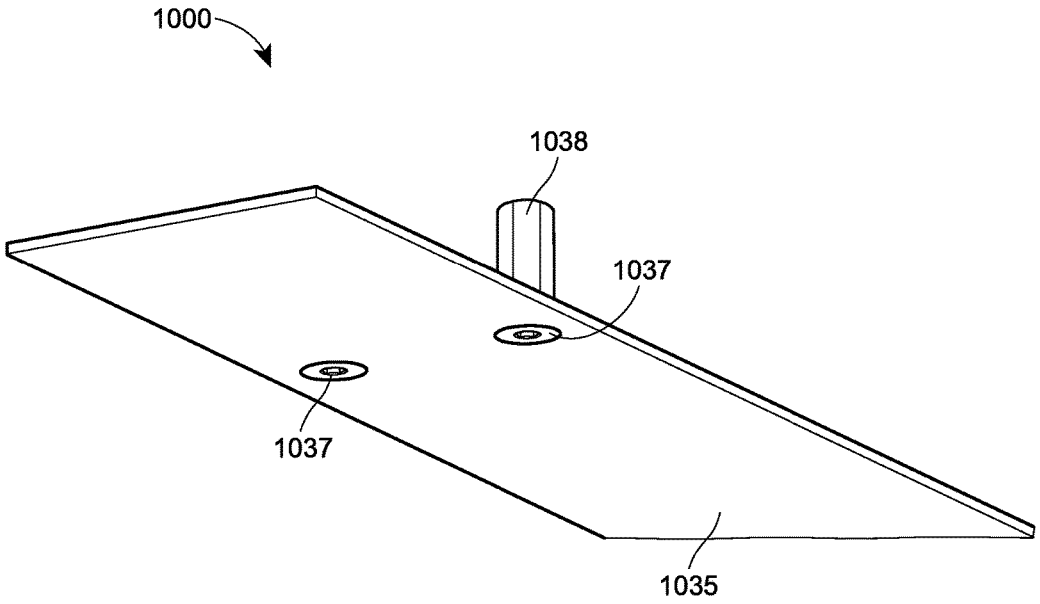
FIG. 10 depicts a portion of an example floor plate with side-by-side mounting feet receptacles for use within the reconfigurable seating system of FIGS. 1A-H and J and FIGS. 13A-D.
Figure 11:
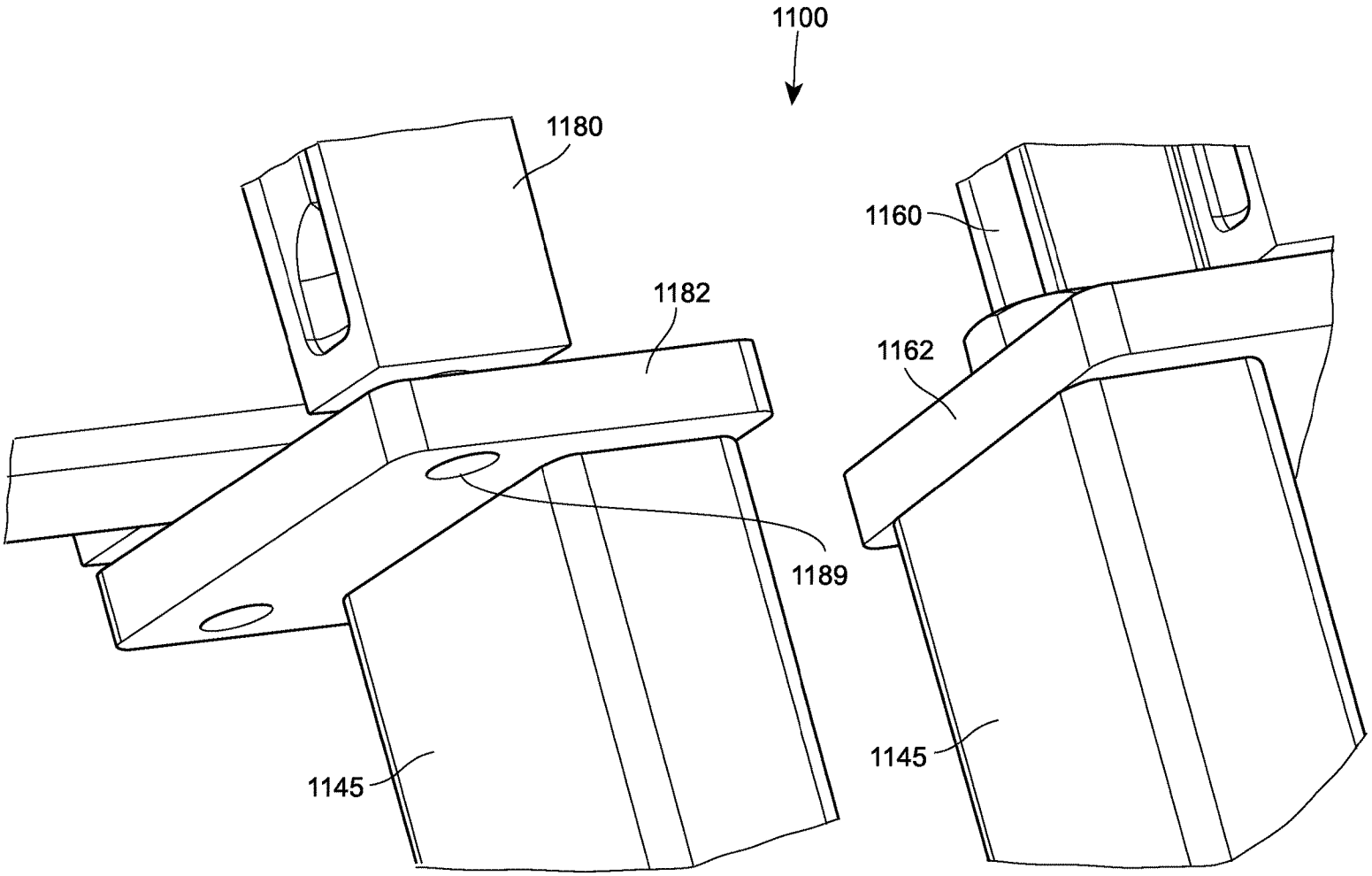

Turning to FIG. 10 a portion 1000 of an example floor plate 1035 with side-by-side mounting feet receptacles 1038 for use within the reconfigurable seating system of FIGS. 1A-H and J and FIGS. 13A-D is depicted. The mounting feet receptacles may be secured to the floor plate 1035 with bolts 1037.

Figure 11:
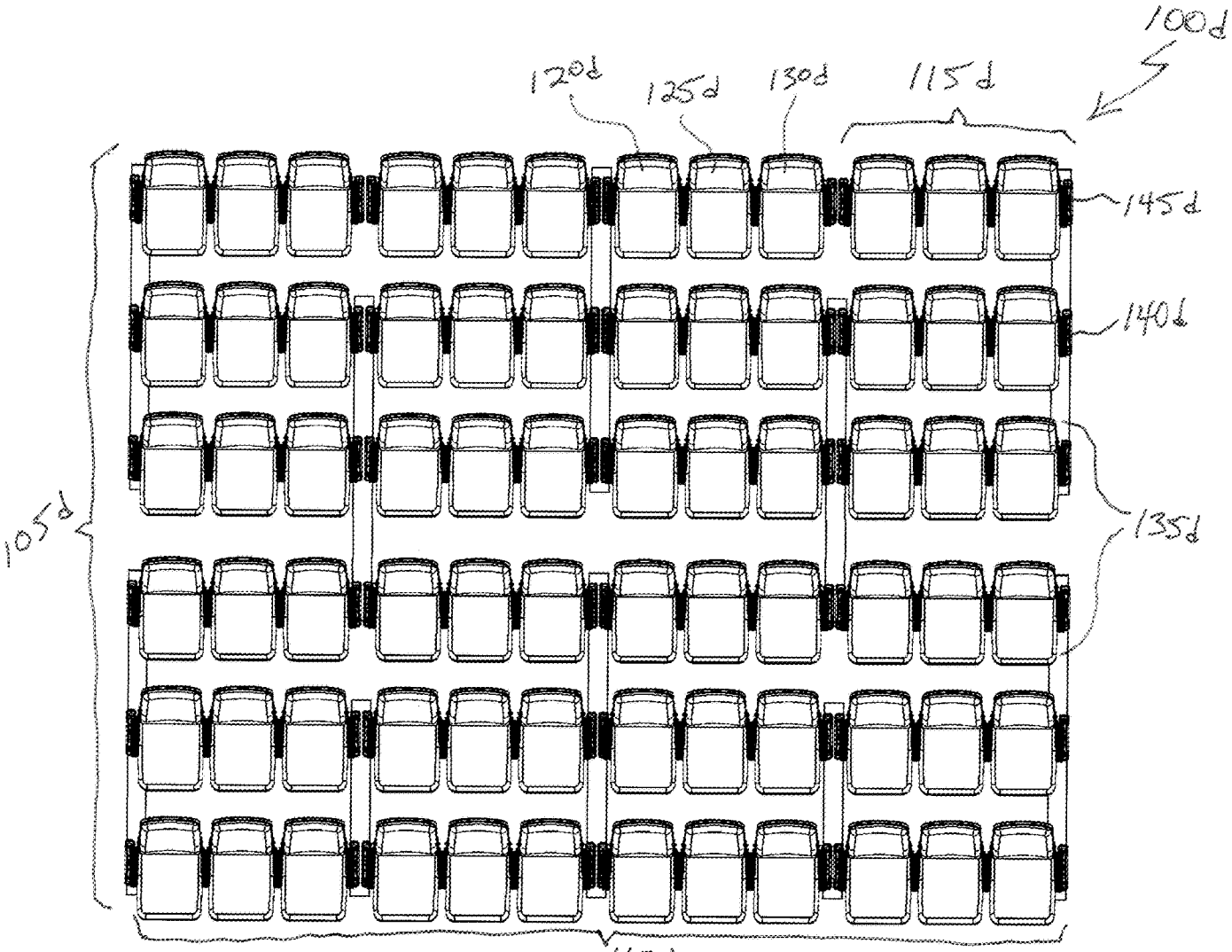
FIG. 11 depicts a portion of example standards for use in the seating units depicted in FIG. 3.

With reference to FIG. 11 a portion 1100 of example standards 1145 for use in seating units 300 depicted in FIG. 3 is depicted. The portion 1100 may include top plates 1162, 1182, a right-hand chair bracket 1160 and a left-hand chair bracket 1180.

Figure 12:
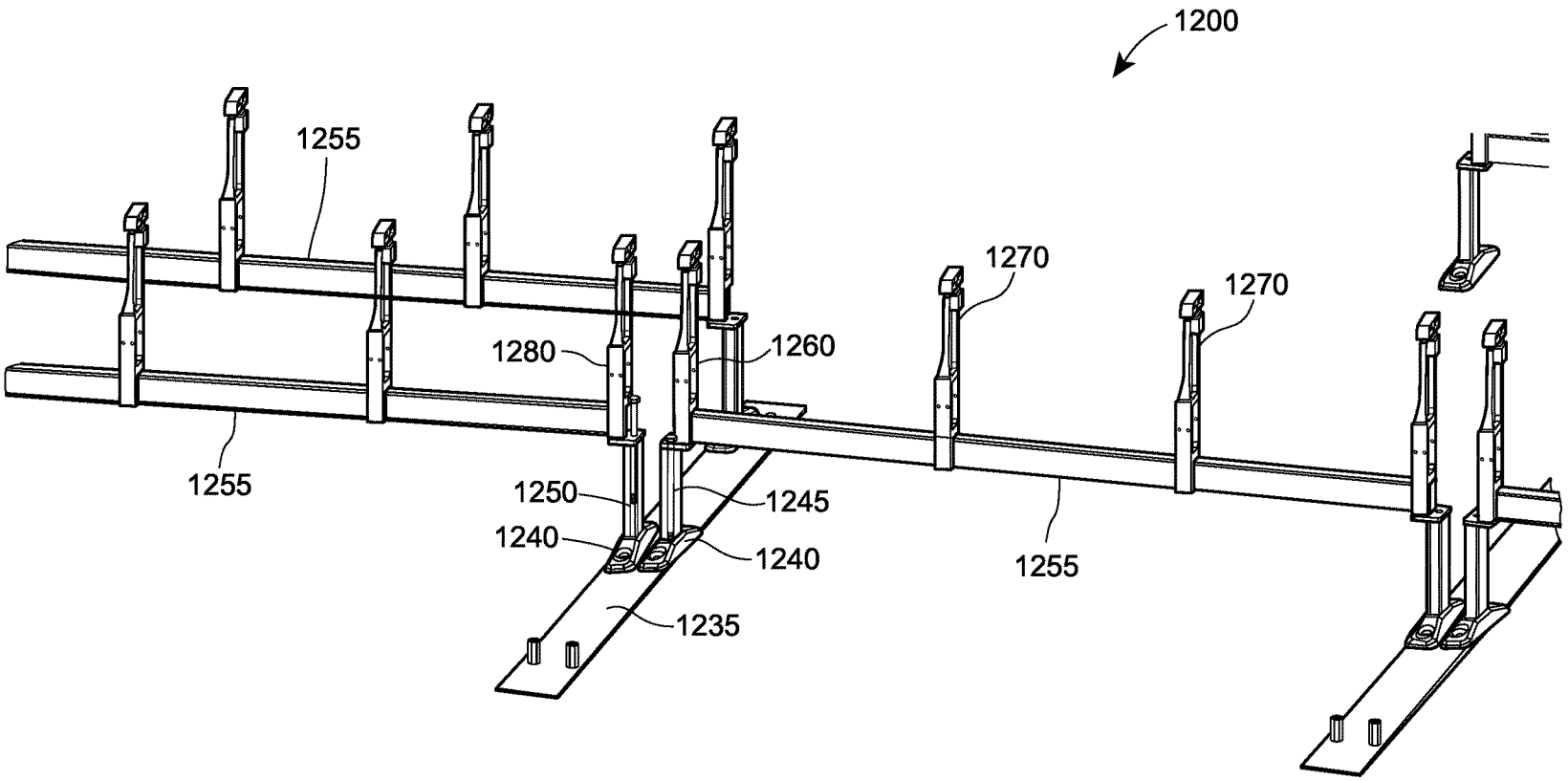
FIG. 12 depicts a portion of example seating units secured to respective floor plates for use within the reconfigurable seating system of FIGS. 1A-H and J and FIGS. 13A-D.
Figure 13A:
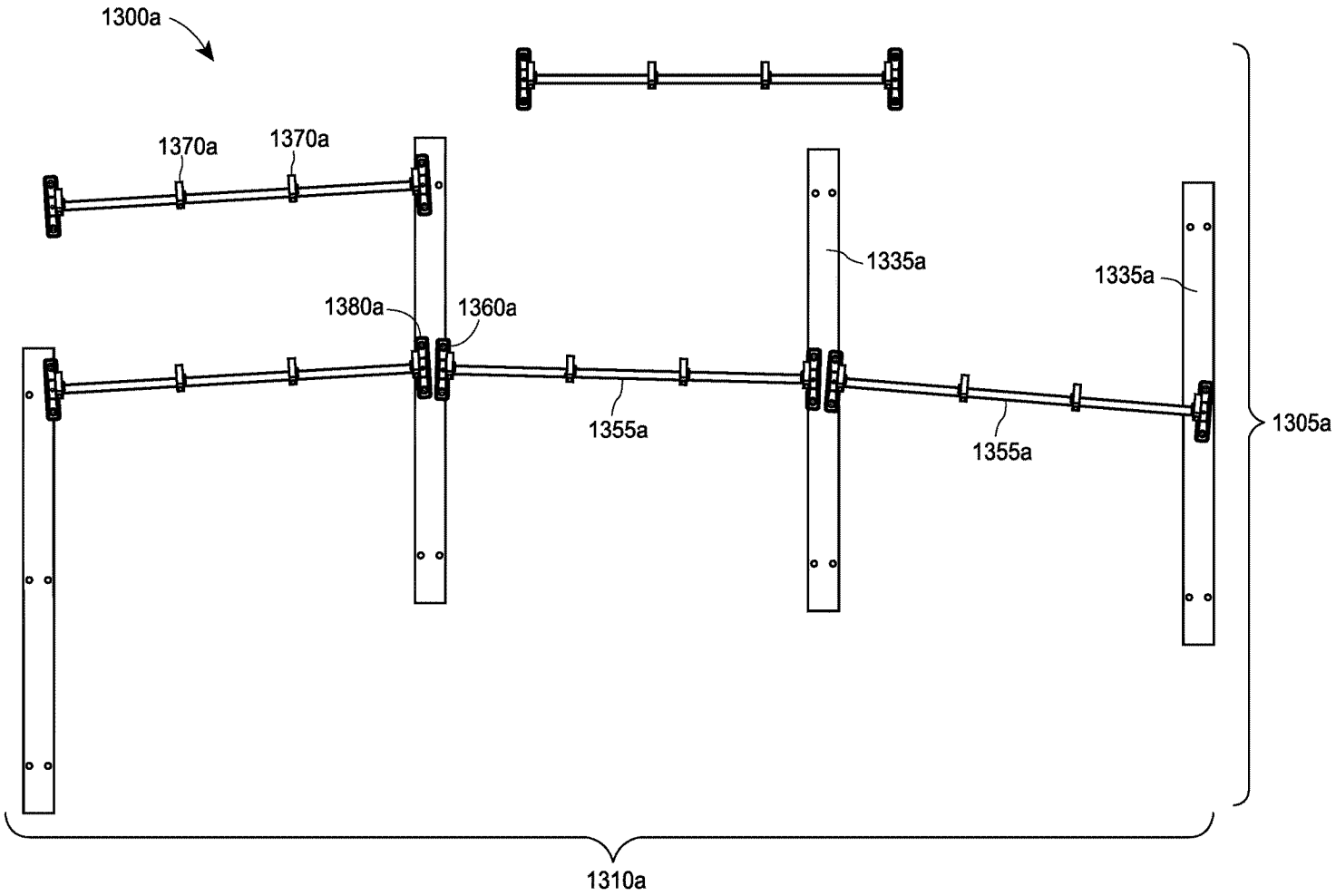
FIGS. 13A-D depict various views of example reconfigurable seating systems and components arranged in an arched-row configuration.
Figure 13B:
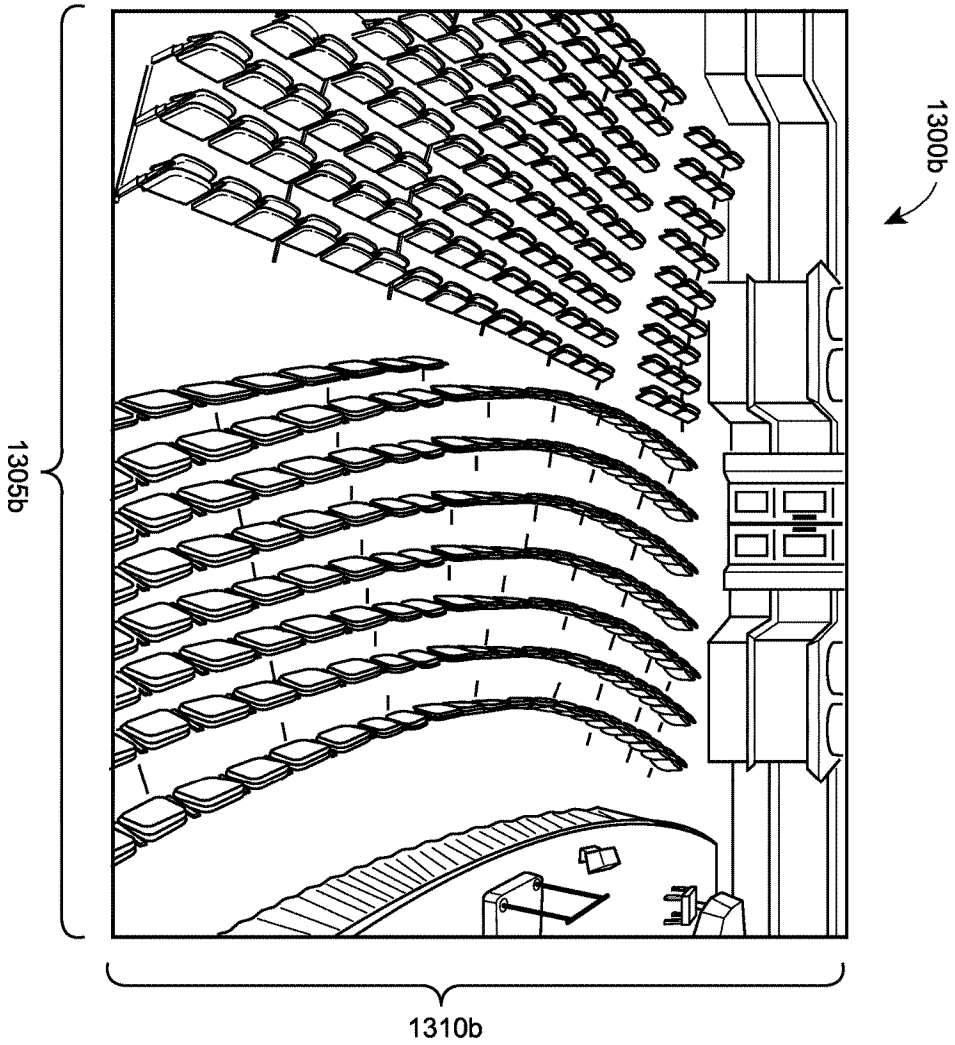
Figure 13C:
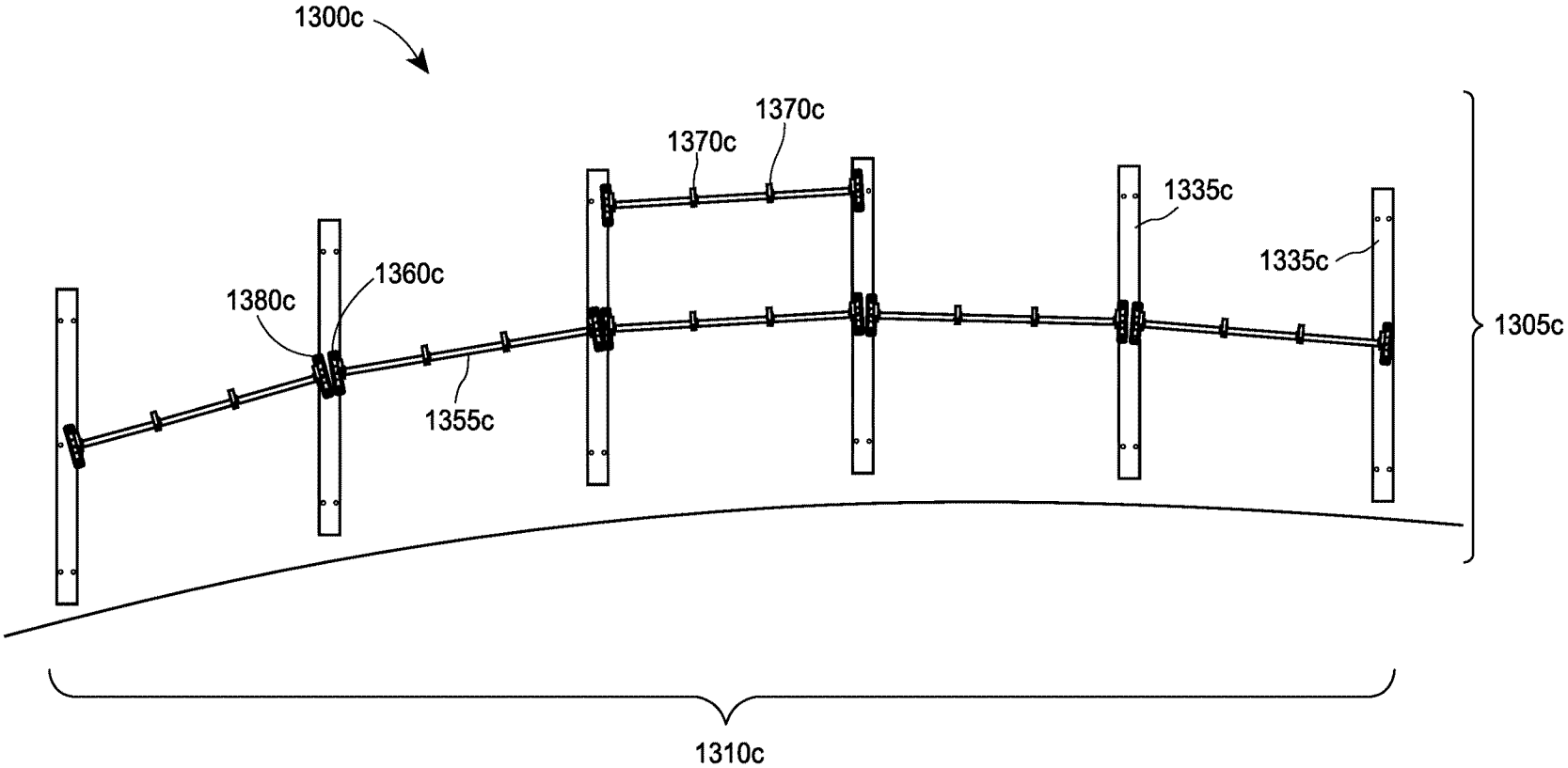
Figure 13D:
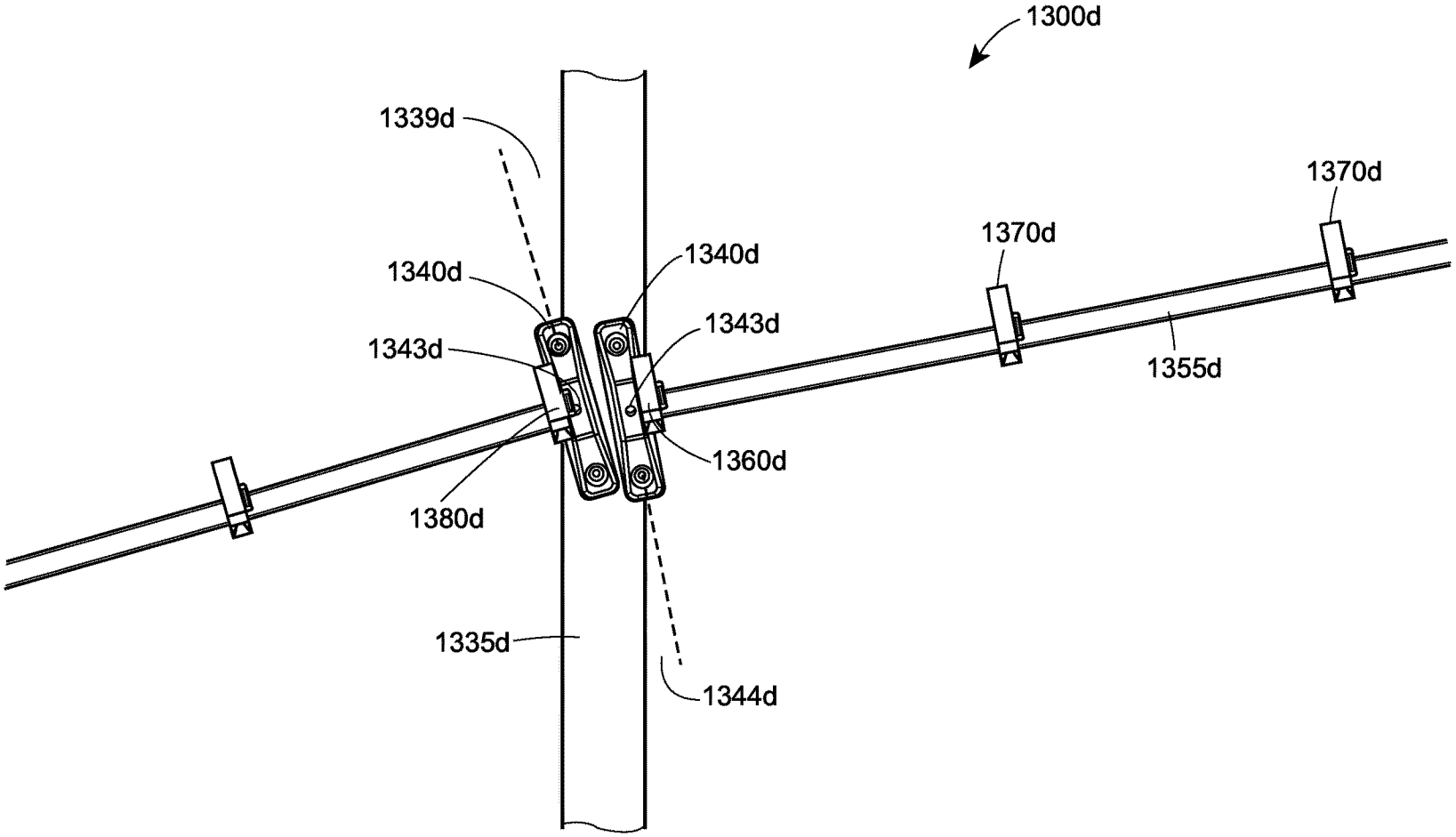

Turning to FIG. 12 a portion 1200 of example seating units secured to respective floor plates 125 for use within reconfigurable seating system 100*a-h* and *j* or 1300*a-d* of FIGS. 1A-H and J and FIGS. 13A-D is depicted. The portion 1200 may include right-hand chair brackets 1260, center chair brackets 1270, left-hand chair brackets 1280, standards 1245, support beams 1255 and standards 1245, 1250.

With reference to FIGS. 13A-D various views of example reconfigurable seating systems and components arranged in an arched-row configuration 1300*a-d* are depicted. The reconfigurable seating systems 1300*a-d* may include rows 1305*a-c* of seating units arranged in columns 1310*a-c*, floor plates 1335*a-d*, support beams 1355*a-d*, right-hand chair brackets 1360*a-d*, center chair brackets 1370*a-d*, left-hand chair brackets 1380*a-d* and mounting feet 1340*d*. The mounting feet 1340*d* may be secured to the floor plate 1335*d* at an angle 1339*d*, 1344*d* to define the arched-row configuration.

Figure 14:
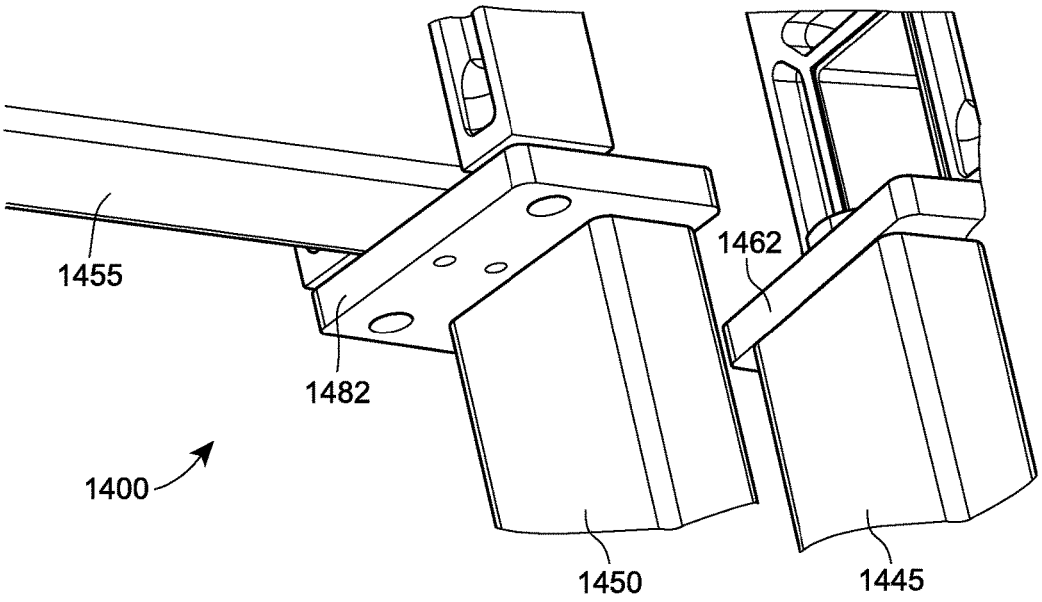
FIG. 14 depicts a portion of example standards for use in the seating units depicted in FIG. 3.

Turning to FIG. 14 a portion 1400 of example standards 1445 for use in seating units 300 depicted in FIG. 3 is depicted. The portion 1400 may include top plates 1462, 1482, a right-hand chair bracket 1460 and a left-hand chair bracket 1480.

Figure 15:
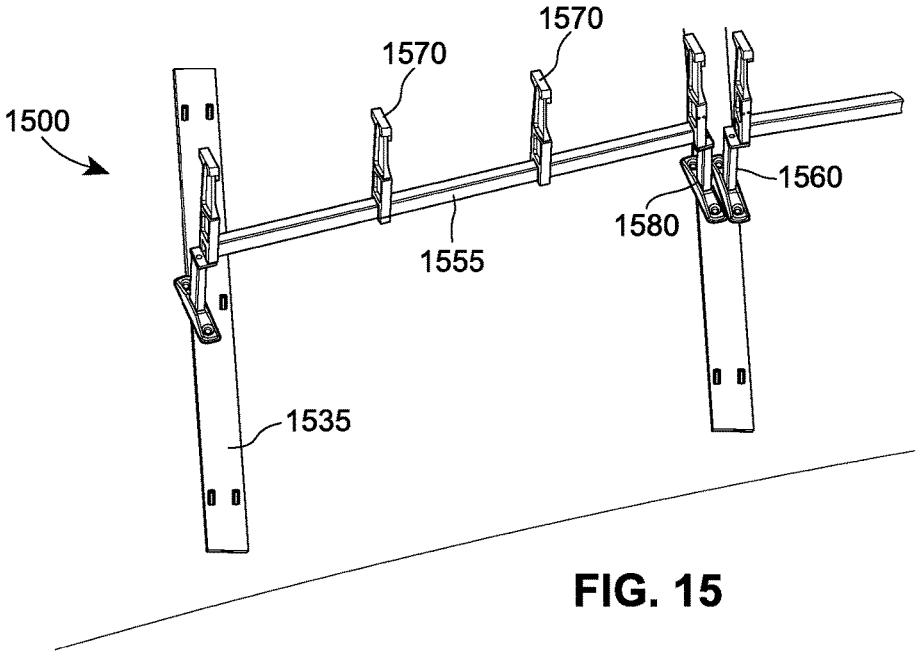
FIG. 15 depicts a portion of example seating units secured to respective floor plates for use within the reconfigurable seating systems of FIGS. 13A-D.

With reference to FIG. 15 a portion of example seating units 1500 secured to respective floor plates 1535 for use within reconfigurable seating systems 1300*a-d* of FIGS. 13A-D is depicted. The seating units 1500 may include right-hand chair brackets 1560, center chair brackets 1570 and left-hand chair brackets 1580.

Figure 16:
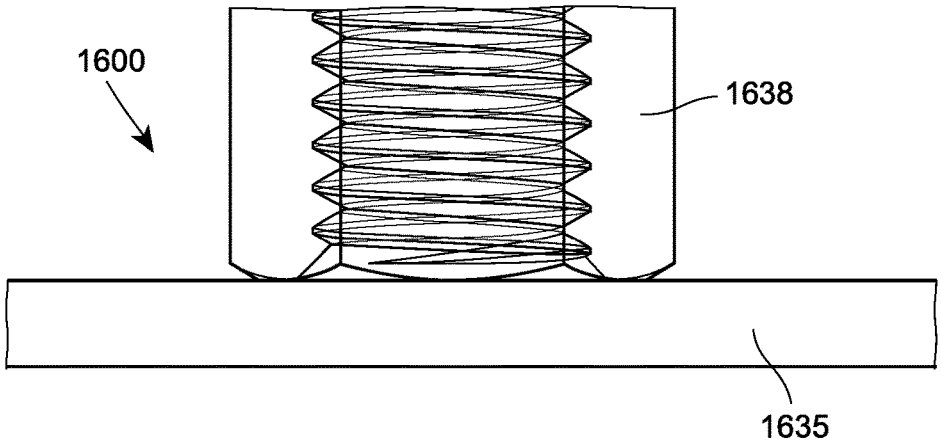
FIG. 16 depicts an example floor plate with a mounting foot receptacle for use within the reconfigurable seating systems of FIGS. 1A-H and J and FIGS. 13A-D.

Turning to FIG. 16 an example floor plate 1635 with a mounting foot receptacle 1638 for use within the reconfigurable seating system 100*a-h* and *j* or 1300*a-d* of FIGS. 1A-H and J and FIGS. 13A-D is depicted.

Figure 17:
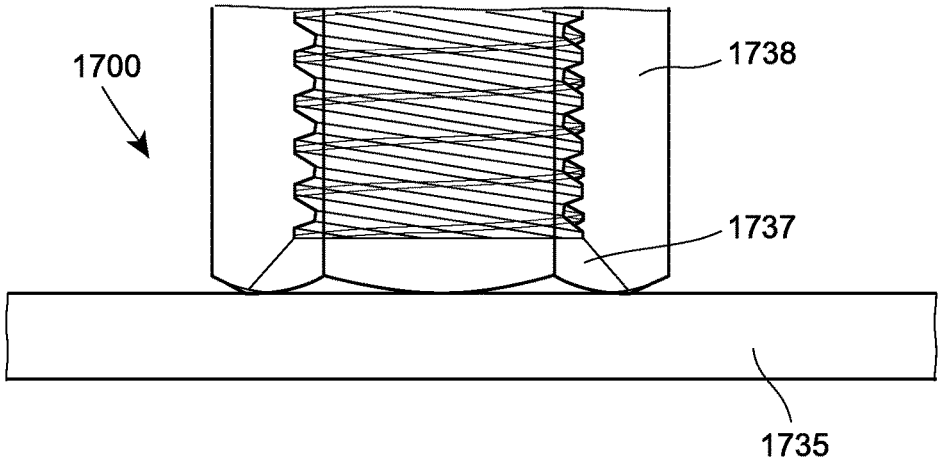
FIG. 17 depicts an example floor plate with a mounting foot receptacle for use within the reconfigurable seating systems of FIGS. 1A-H and J and FIGS. 13A-D.

With reference to FIG. 17 an example floor plate 1735 with a mounting foot receptacle 1738 having a tapered interior end 1737 for use within the reconfigurable seating systems 100*a-h* and *j* or 1300*a-d* of FIGS. 1A-H and J and FIGS. 13A-D is depicted.

Figure 18:
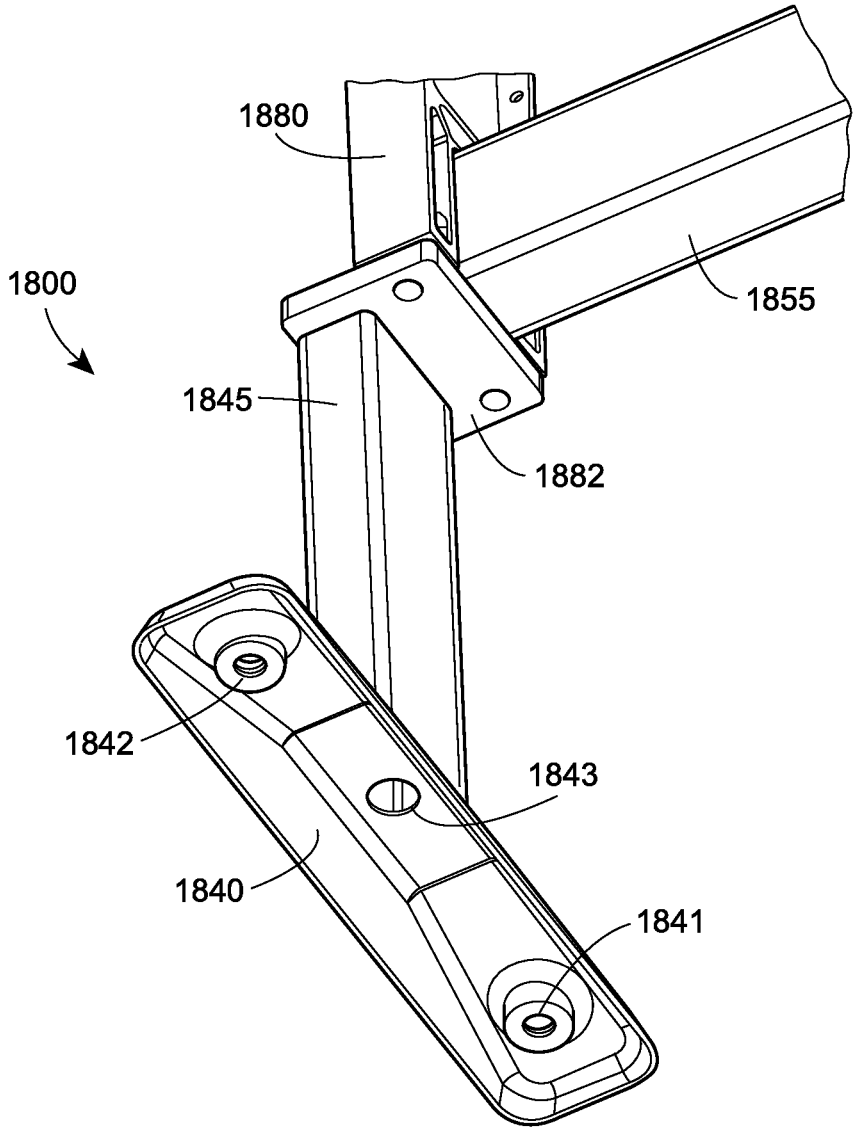
FIG. 18 depicts an example standard and mounting foot for use in the reconfigurable seating systems of FIGS. 1A-H and J and FIGS. 13A-D.

Turning to FIG. 18 an example 1800 standard 1845 and mounting foot 1840 for use in reconfigurable seating systems 100*a-h* and *j* or 1300*a-d* of FIGS. 1A-H and J and FIGS. 13A-D is depicted. The example 1800 may include a right-hand chair bracket 1880, a support beam 1855 and a top plate 1882. The mounting foot 1840 may include a first bolt hole 1841, a second bolt hole 1842 and a mount foot receptacle hole 1843.

Figure 19A:
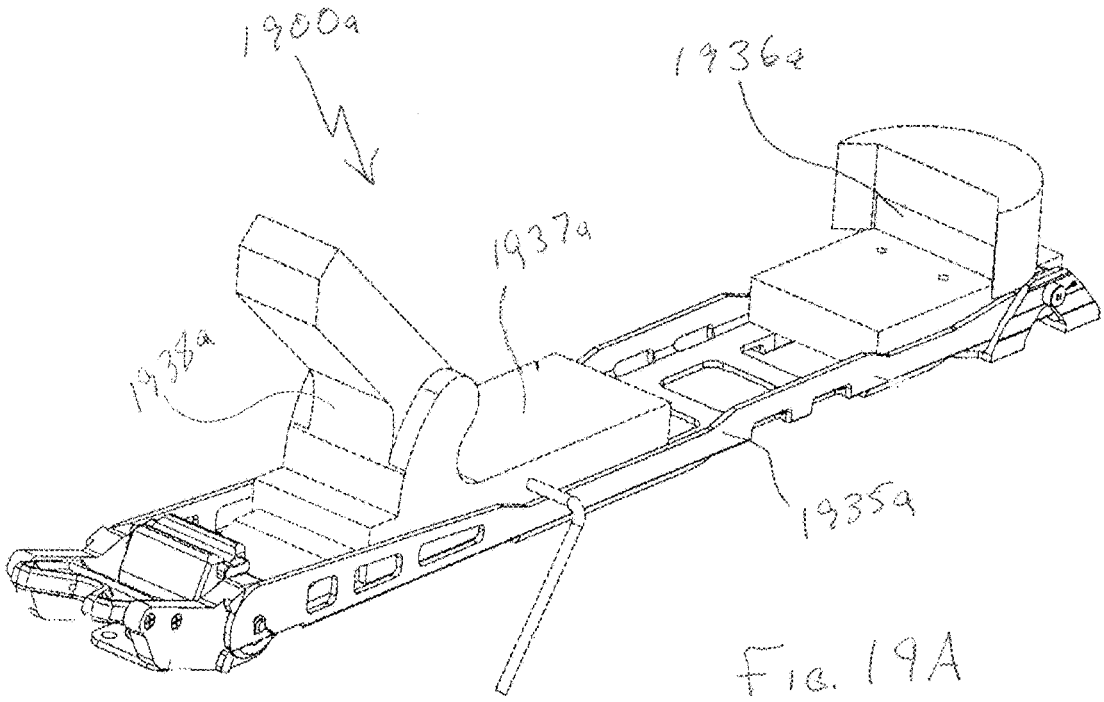
FIGS. 19A and 19B depict an example mounting foot and receptacle for use within the reconfigurable seating systems of FIGS. 1A-H and J and FIGS. 13A-D.
Figure 19B:
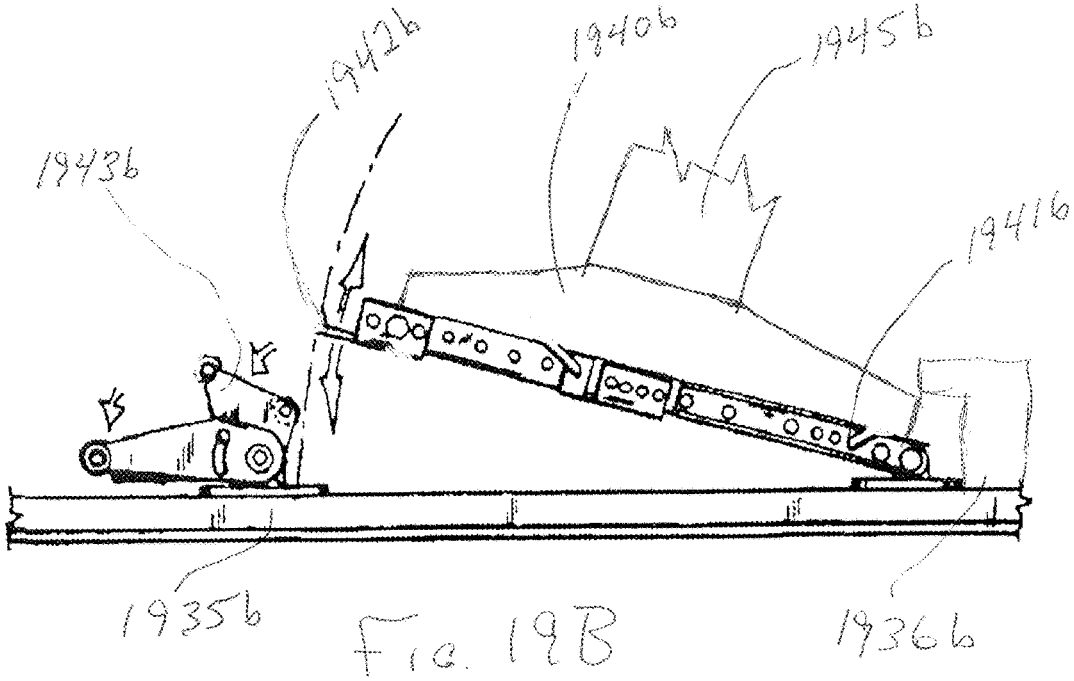
Figures 20A, 20B, 20C, 20D:
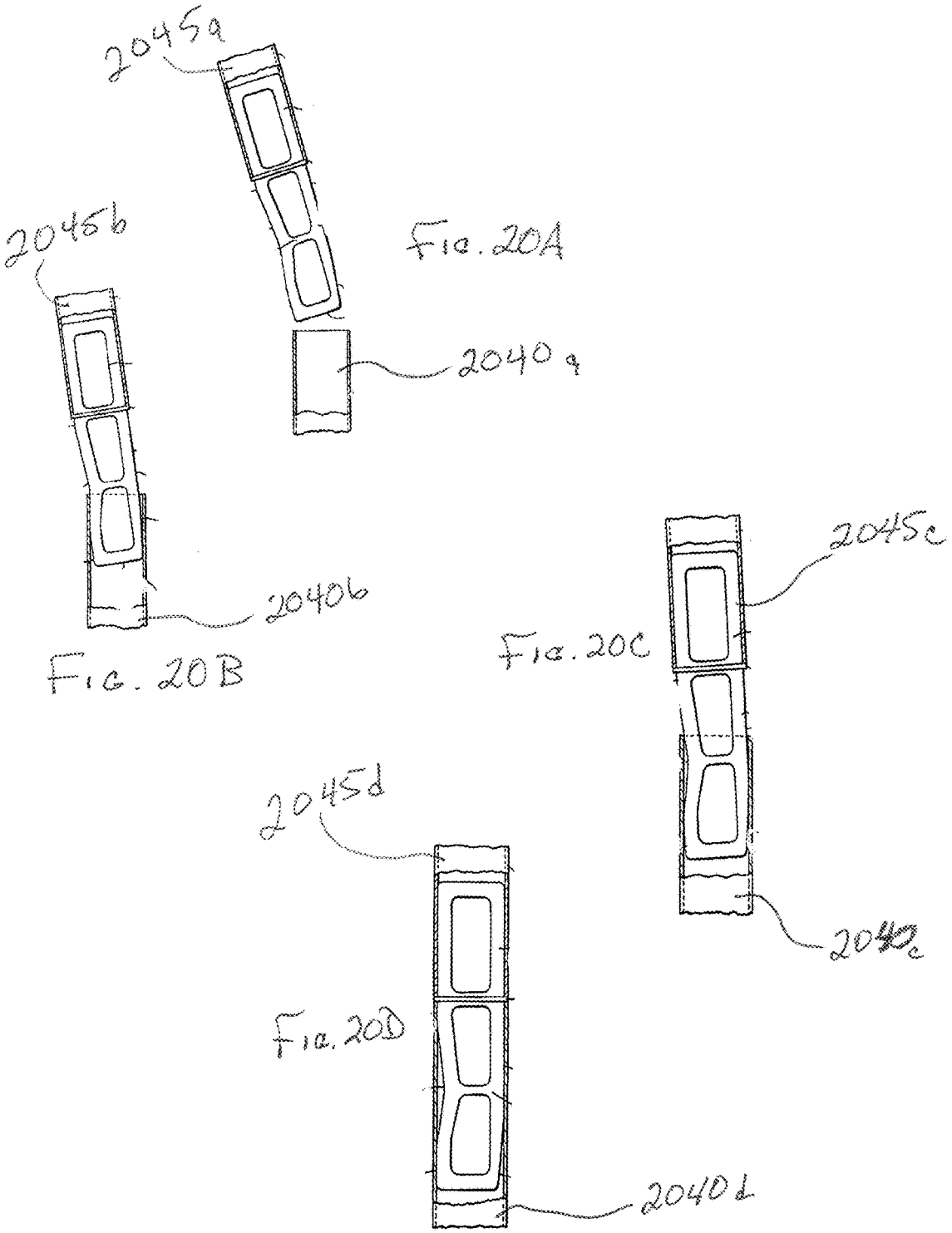
FIGS. 20A-20D depict and example mounting foot and receptacle for use within the reconfigurable seating systems of FIGS. 1A-H and J and FIGS. 13A-D.

With reference to FIGS. 19A and 19B an example mounting foot 1940*b* and receptacle 1935*a*, 1935*b* for use within reconfigurable seating systems 100*a-h* and *j* or 1300*a-d* of FIGS. 1A-H and J and FIGS. 13A-D are depicted. The receptacle 1935*a*, 1935*b* may include a fixed latch 1936*a*, 1936*b*, a pivotable latch 1937*a* and a latch release mechanism 1938*a*. The pivotable latch 1937*a* and the latch release mechanism 1938*a* may be combined into a combination pibotable latch/latch release 1943*b*. The mounting foot 1940*b* may include a first hook 1941*b* to engage the fixed latch 1936*a*, 1936*b* and a second hook 1942*b* to engage the pivotable latch 1937*a*, 1943*b*.

Turning to FIGS. 20A-20D example mounting foot 2045*a-d* and receptacle 2040*a-d* are depicted for use within the reconfigurable seating systems of FIGS. 1A-H and J and FIGS. 13A-D. Each mounting foot 2045*a-d* cooperates with its receptacle 2040*a-d*. It will be appreciated from FIGS. 20A-20D that the mounting foot 2045*a-d* includes an attachment portion which may be permanently fixed within a respective seating unit.

Figure 21:
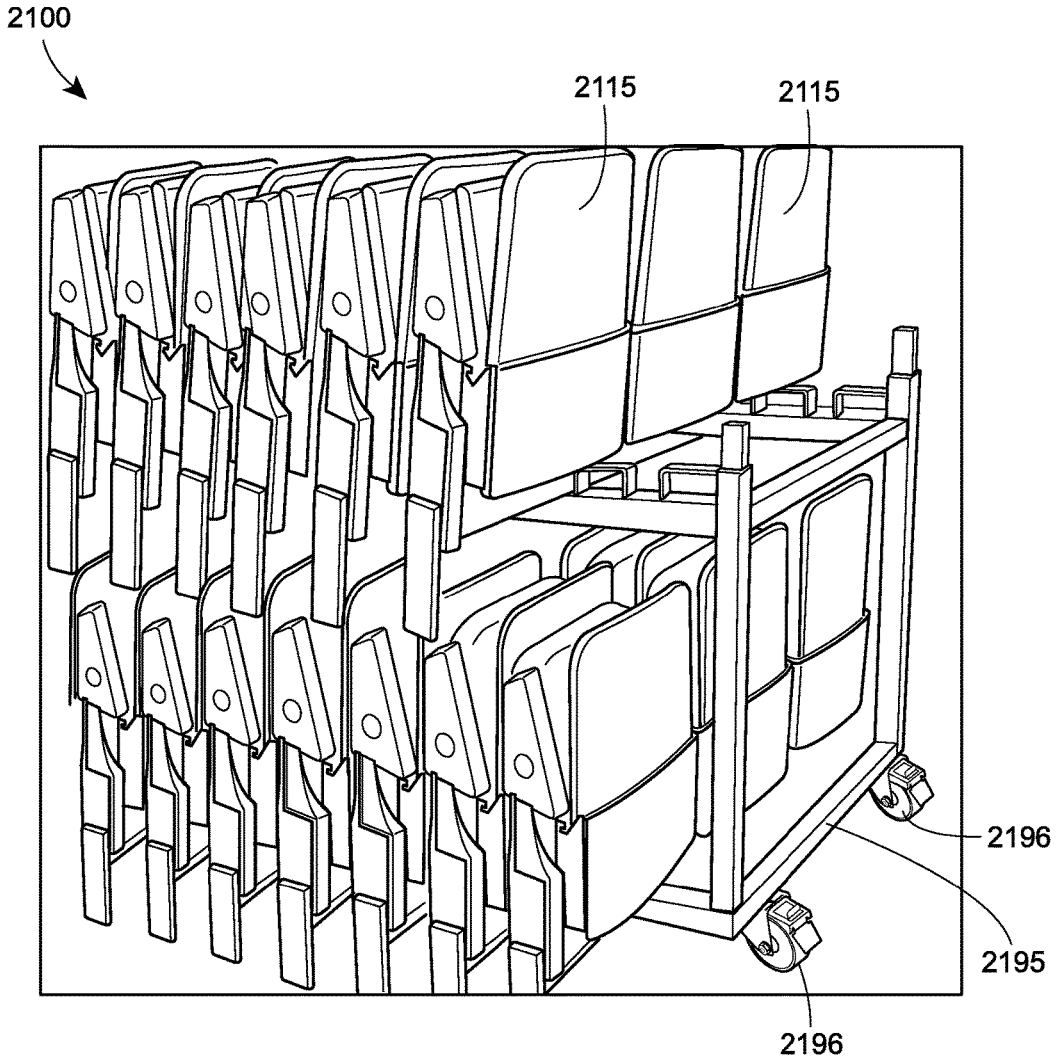
FIGS. 21-23 depict various stillages for moving and storing seating units and floor plates of the reconfigurable seating systems of FIGS. 1A-H and J and FIGS. 13A-D.
Figure 22:
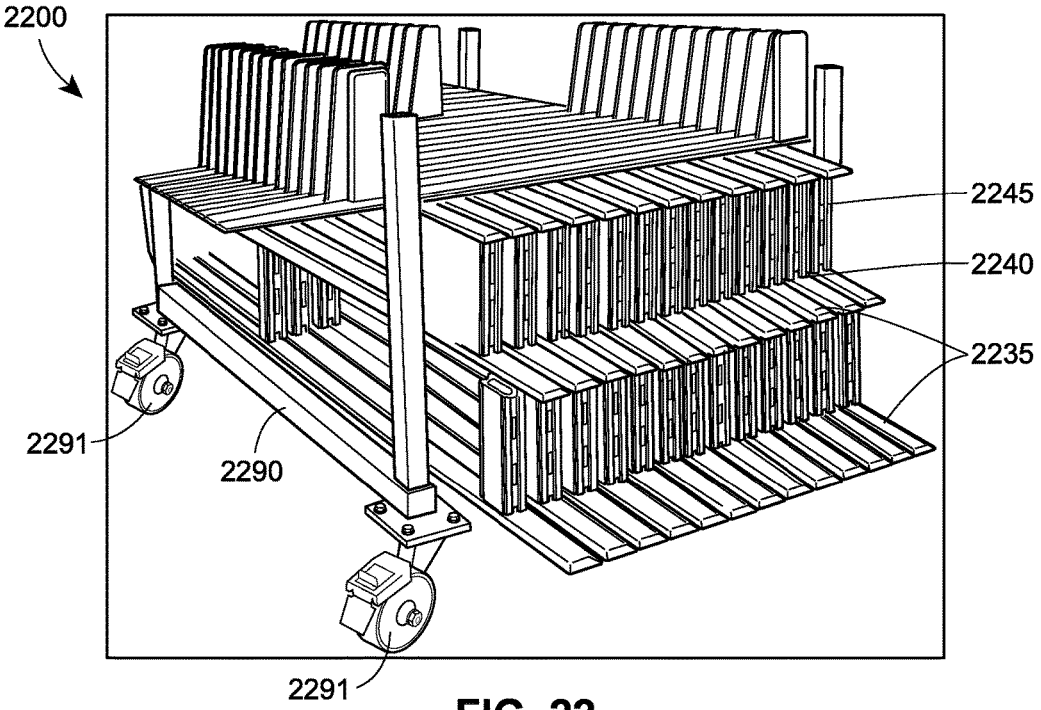
Figure 23:
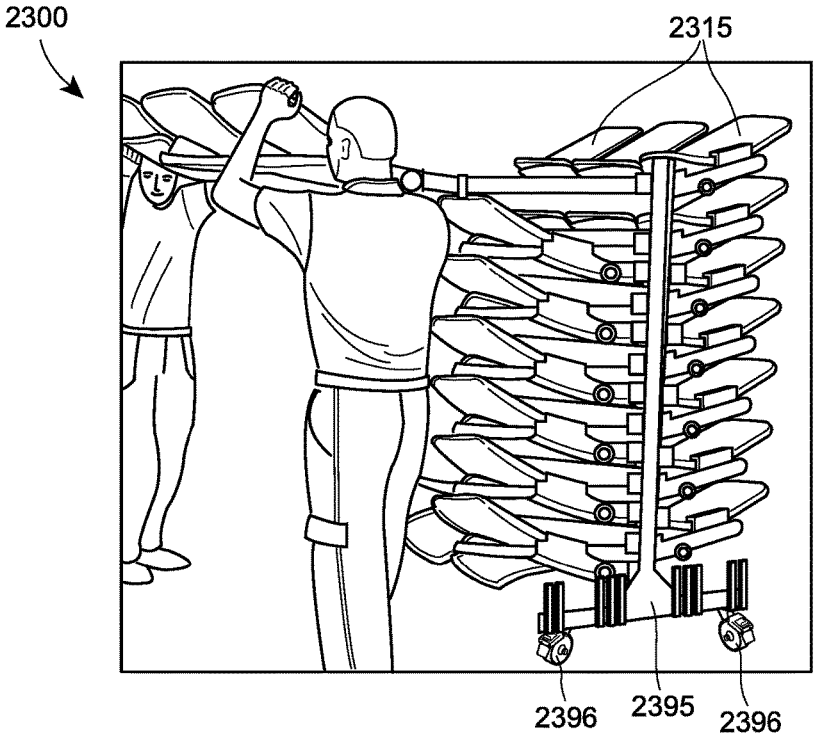

With reference to FIGS. 21-23 various stillages for moving and storing seating units and floor plates of the reconfigurable seating systems of FIGS. 1A-H and J and FIGS. 13A-D are depicted. The stillage 2100 may include a frame 2195 supported on wheels 2196 and may be configured to store and transport seating units 2115. The stillage 2200 may include a frame 2290 and wheels 2291 and may be configured to store and transport floor plates 2235. The stillage 2200 may alternatively be configured to store and transport floor plates 2235 with mounting feet 2240 and/or standards 2245 attached to the floor plates 2235. The stillage 2300 may include a frame 2395 supported on wheels 2396 and may be configured to store and transport seating units 2315.

Figure 24A:
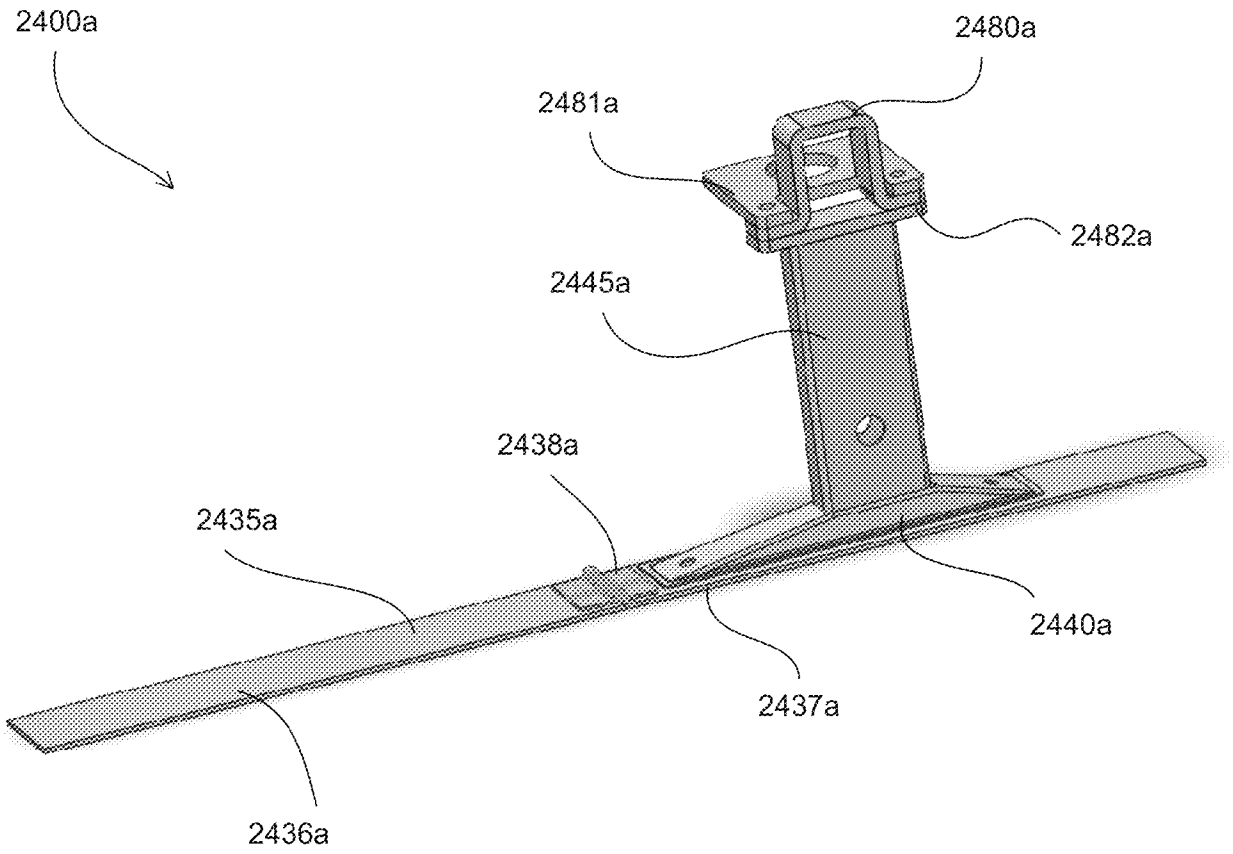
FIGS. 24A-C depict an example hinged floor plate.
Figure 24B:
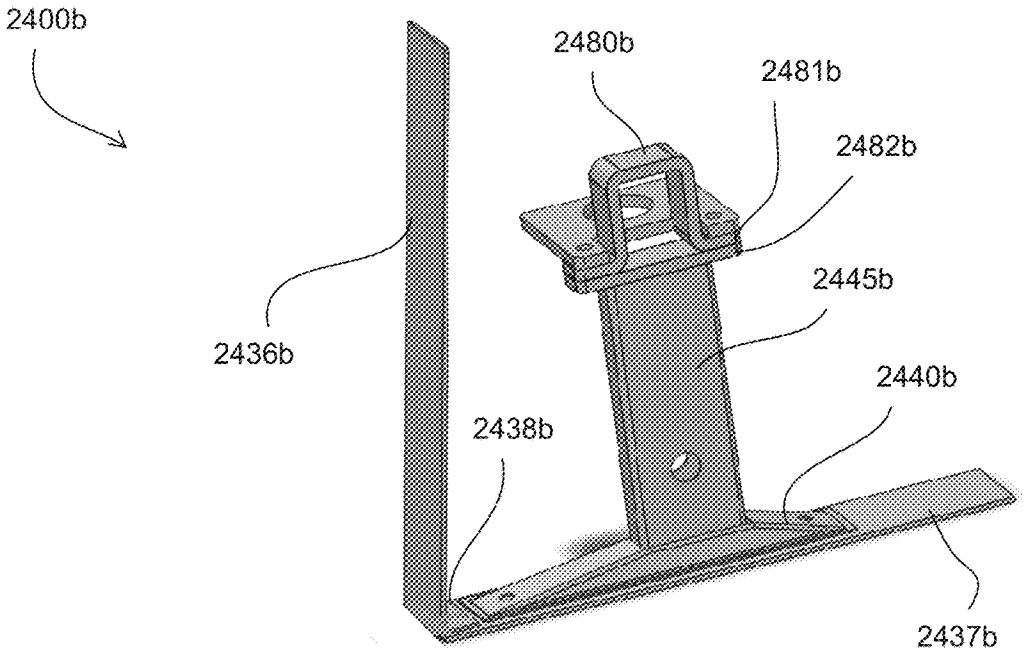
Figure 24C:
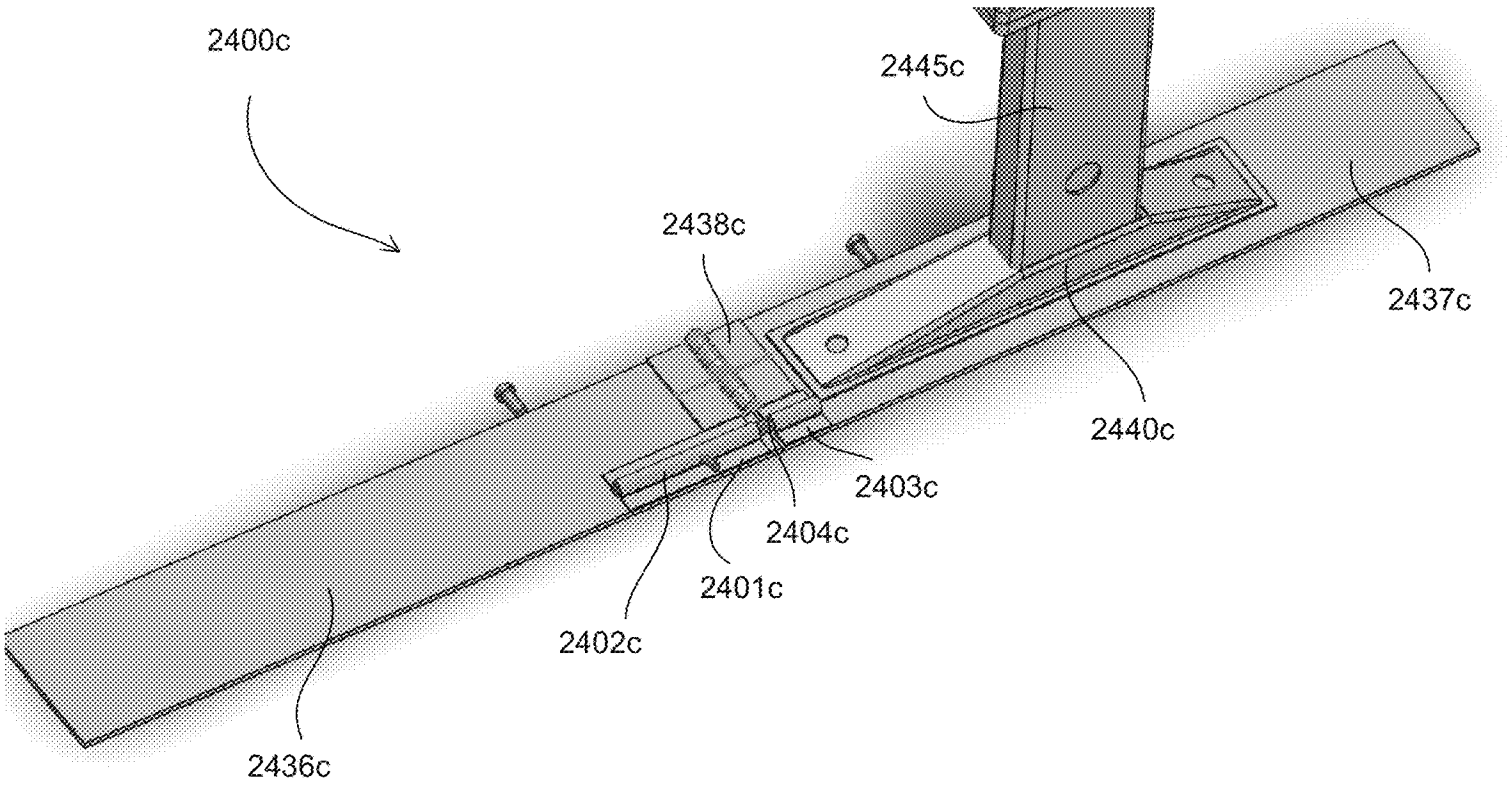

Turning to FIGS. 24A-C, various assembly views 2400*a-c* are depicted of an example hinged floor plate 2435*a-c*. The assemblies 2400*a-c* may include a standard 2445*a-c* that may be, for example, removably secured to a mounting foot 2440*a-c* that may be, for example, removably secured to a floor plate 2435*a*. The standard 2445*a-c* may include a chair bracket 2480*a*, 2480*b*, a bushing 2481*a*, 2481*b* and a top plate 2482*a*, 2482*b*. The floor plate 2435*a* may include a first section 2436*a-c* pivotally attached to a second section 2437*a-c* via a hinge 2438*a-c*. Any given assembly 2400*a-c* may further include a latch 2401*c* having a pin 2404*c* slidably arranged within a first receptacle 2402*c*. When the first section 2436*a-c* of the floor plate 2435*a* is aligned with the second section 2437*a-c* of the floor plate 2435*a*, the pin 2404*c* may be slid to engage the second receptacle 2403*c* to, for example, secure the first section 2436*a-c* relative to the second section 2437*a-c* of the floor plate 2435*a*. While the first receptacle 2402*c* is depicted as being attached to the first section 2436*a-c* and the second receptacle 2403*c* is depicted as being attached to the second section 2437*a-c*, the first receptacle 2402*c* may be attached to the second section 2437*a-c* and the second receptacle 2403*c* may be attached to the first section 2436*a-c*. Thus, the floor plate 2435*a* may facilitate flexibility in floor slope, movement and storage.

Figure 25A:
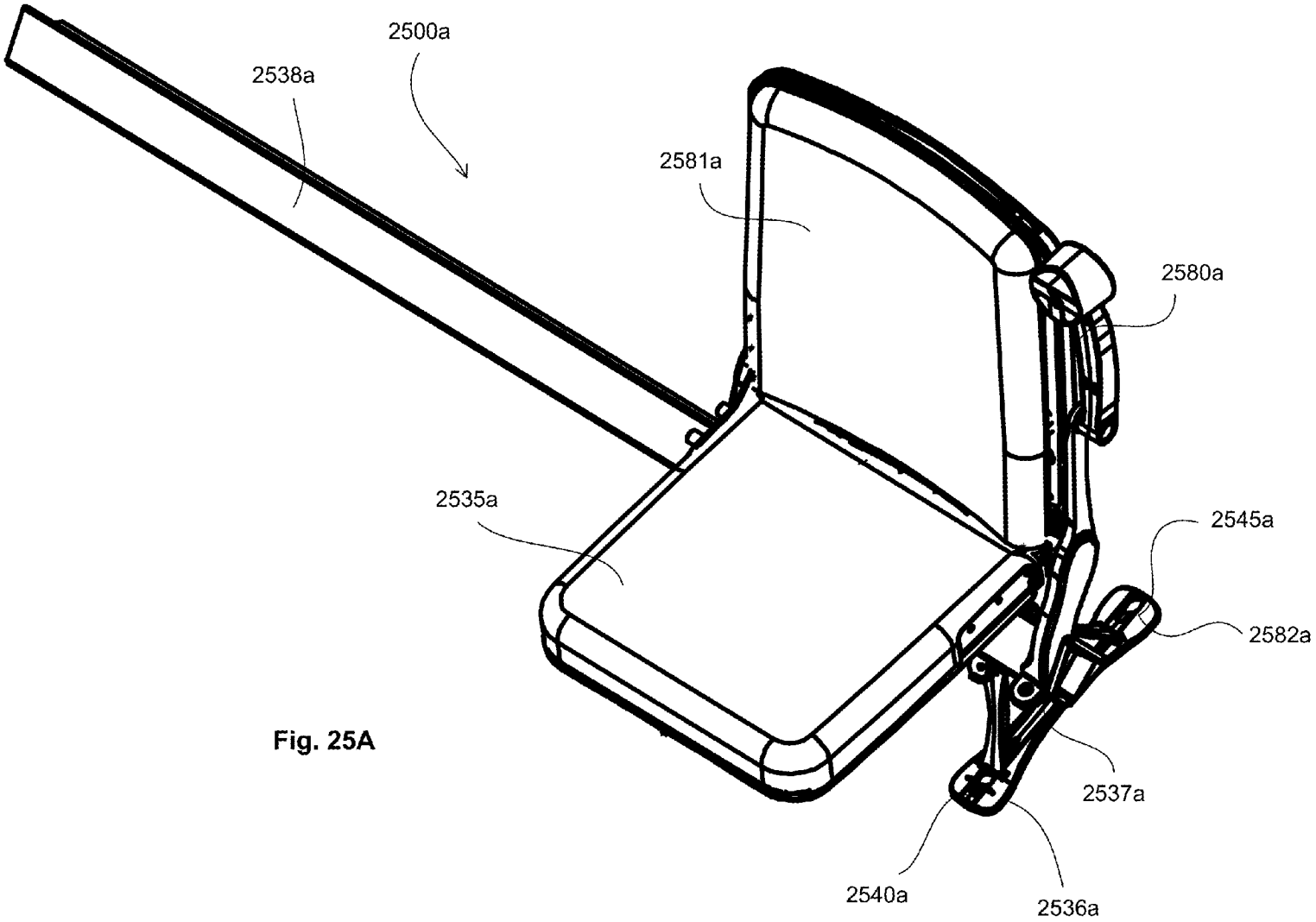
FIGS. 25A-25D depict various views of an example beam mounted seating unit.
Figure 25B:
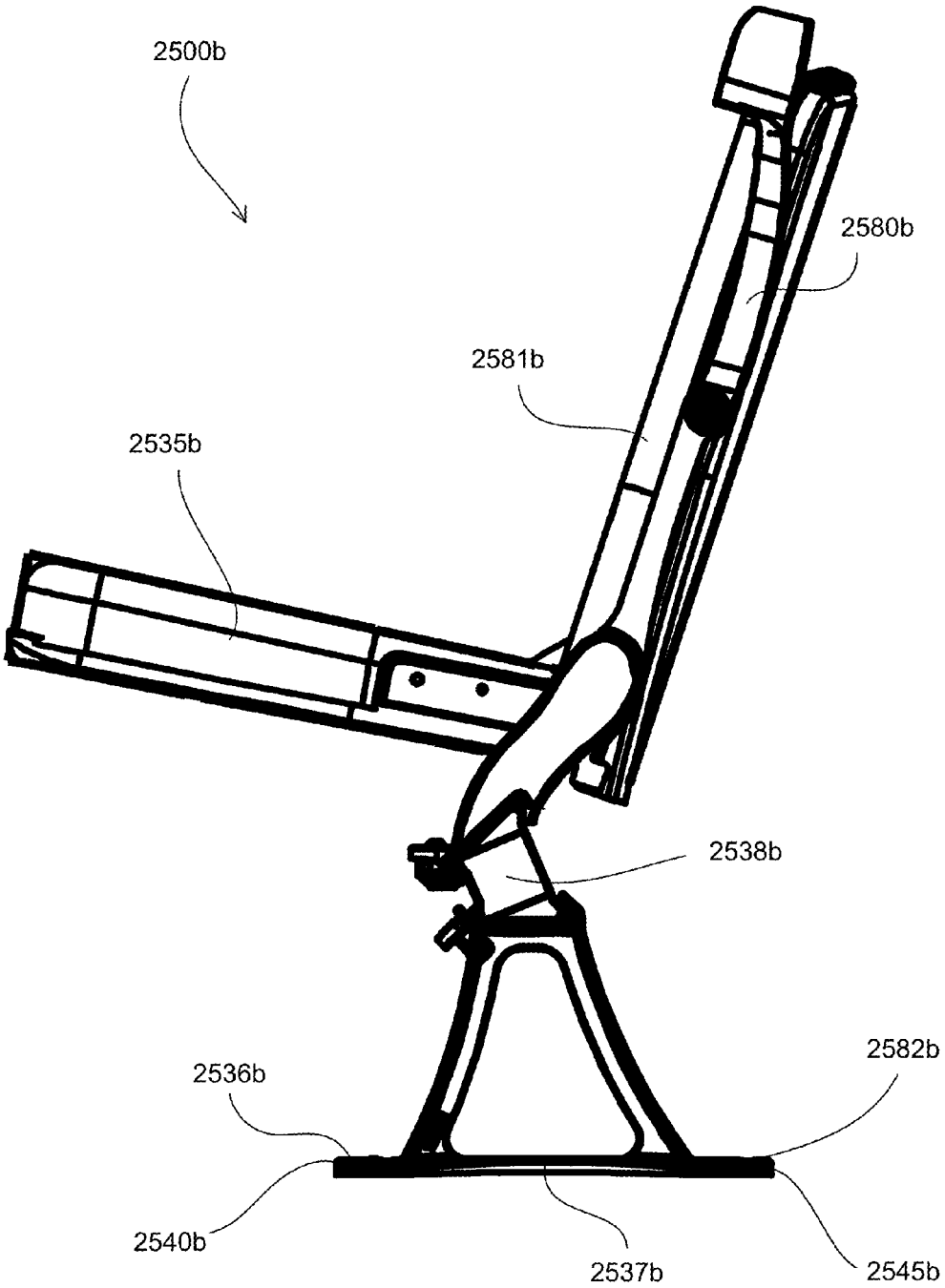
Figure 25C:
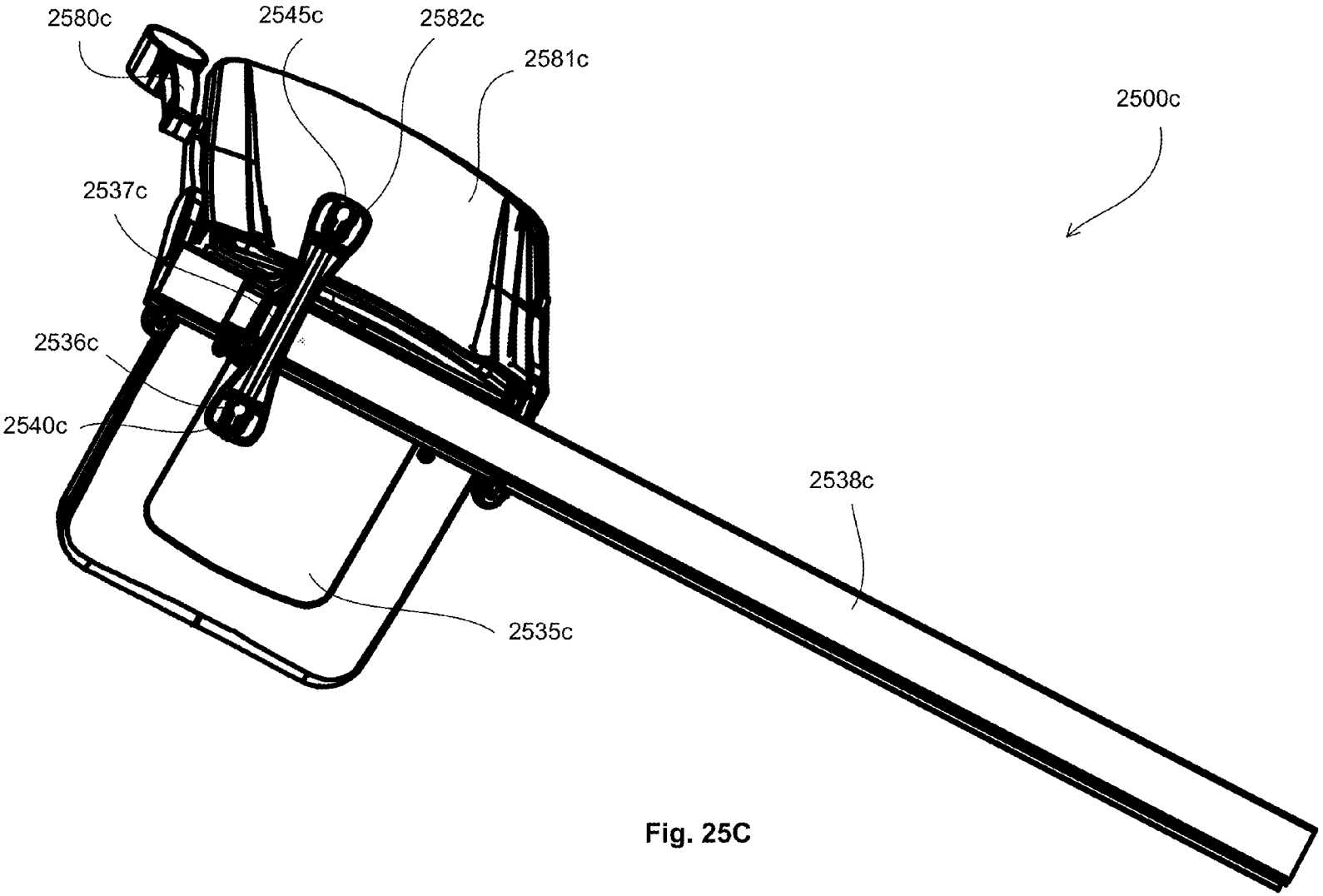
Figure 25D:
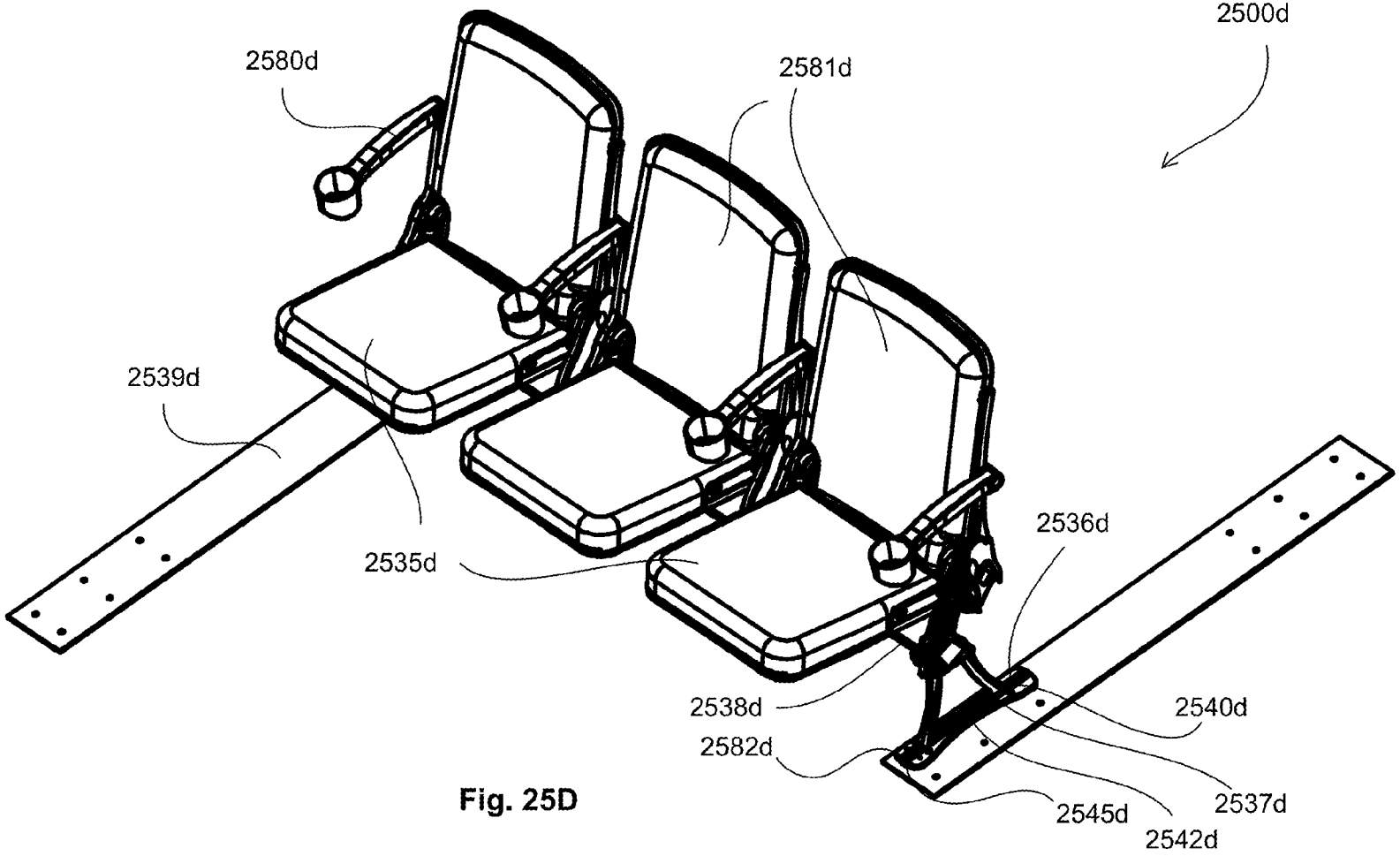

With referenced to FIGS. 25A-25D, an example beam mounted seating unit 2500*a-d* may include at least one chair (i.e., chair back 2581*a-d*, chair seat 2532*a-d*, and related beam mounting/seat pivot structure) mounted to a beam 2538*a-d*. Any given beam mounted seating unit may be as described in U.S. provisional application Ser. No. 62/018,854, entitled BEAM MOUNTED CHAIR ASSEMBLIES, CHAIR ASSEMBLIES FOR USE WITHIN THE BEAM MOUNTED CHAIR ASSEMBLIES, COMPONENTS FOR USE WITHIN THE CHAIR ASSEMBLIES AND PARTS FOR USE WITHIN THE COMPONENTS, as filed on Jun. 30, 2014, the entire disclosure of which is incorporated by reference herein. While only one chair is illustrated in FIGS. 25A-25C, it should be understood that any given beam mounted seating unit 2500*a-c* may include any number of chairs such as, for example, that shown in FIG. 25D. While the chair of FIGS. 25A-25C is depicted as including only one arm 2580*a-c*, it should be understood that any given chair may include two arms 2580*a-d* (i.e., one arm on either side of the chair) as shown in FIG. 25D. For example, a beam mounted seating unit 2500*d* may include at least three chairs, at least two of the at least three chairs may include one arm 2580*d*, and one of the at least three chairs may include two arms 2580*d*.

A beam mounted seating unit 2500*a-d* may be configured such that a beam 2538*a-d* is supported by a support structure 2537*a-d*. While only one support structure is shown in FIGS. 25A-25C, it should be understood that any given beam mounted seating unit may include any number of support structures 2537*a-c*, for example, two support structures 2537*d* of FIG. 25D. A support structure 2538*a-d* may include a front mounting foot 2536*a-d* having a front slotted hole 2540*a-d* and a rear mounting foot 2545*a-d* having a rear slotted hole 2582*a-d*. As depicted in FIG. 25D, any given support structure 2537*d* may include a middle slotted hole

2542*d*, such that the associated seating unit 2500*d* may be configured within a curved row as illustrated, for example, in FIG. 15. The front slotted hole 2582*a-d* and/or the rear slotted hole 2582*a-d* may include a raised rib to encage an associated fastener (e.g., a bolt head or a nut). The front slotted hole 2582*a-d* and/or the rear slotted hole 2582*a-d*, and associated fasteners, may be configured such that the given beam mounted seating unit 2500*a-d* may be removably secured to a floor plate 2539*d*, for example, without using any hand tools.

It will be appreciated that the seating arrangements shown in the Figures are highly adaptable, and can be used to provide a variety of seating plans, ranging from a single unit of three seats, as shown in FIG. 1, to a block of several hundred interlinked seats. The use of relatively thin floor plates (e.g., less than ½" thick), and with the chair seats tipped up as shown in FIG. 1, the seating units themselves offer very little obstruction to people walking past them, or between adjacent rows. Furthermore, when the seating units are separated from the floor plates, the seating units can be packed closely, for example in stillages, in a manner requiring very little storage space. Because each seating unit comprises more than one chair, deployment and clearance of the seating can be performed quickly, with one person able to deal with three seats, for example, at a time, rather than with only one chair as in the case of known systems.

This detailed description is to be construed as exemplary only and does not describe every possible embodiment, as describing every possible embodiment would be impractical, if not impossible. One could implement numerous alternate embodiments, using either current technology or technology developed after the filing date of this application.

What is claimed is:

1. A reconfigurable seating system, comprising:

at least one seating unit having at least two mounting feet, wherein the mounting feet are rotatably attached to a respective standard;

at least two floor plates, wherein a first one of the at least two floor plates includes at least one first mounting foot receptacle for releasably receiving a first mounting foot of the at least two mounting feet, wherein a second one of the at least two floor plates includes at least one second mounting foot receptacle for releasably receiving a second mounting foot of the at least two mounting feet, and wherein the at least one seating unit is adjustable between a flat floor orientation and a sloped floor orientation by rotating the at least two mounting feet relative to the respective standard; and at least one floor plate attachment, wherein the at least one floor plate attachment is configured to secure the at least one seating unit, to an associated floor, in a predetermined location.

2. A reconfigurable seating system as in claim 1, wherein the at least one seating unit is adjustable between a first height and a second height.

3. A reconfigurable seating system as in claim 1, wherein the at least one seating unit includes a plurality of individual chairs.

4. A reconfigurable seating system as in claim 3, wherein at least one of the chairs, of the at least one seating unit, is foldable.

5. A reconfigurable seating system as in claim 1, further comprising a plurality of seating units arranged in a rows, wherein the rows define a substantially straight row or a curved row.

6. A reconfigurable seating system as in claim 1, wherein the at least one seating unit includes at least three chairs disposed side-by-side on a beam, wherein at least two of the at least three chairs includes a single arm, and wherein at least one of the at least three chairs includes two arms.

7. A reconfigurable seating system as in claim 1, further comprising a plurality of seating units arranged in at least two rows, wherein at least one of the at least two floor plates includes at least one third mounting foot receptacle for releasably receiving a third mounting foot, and wherein the third mounting foot is located in a second row different than a first row where the first and second mounting foot are located.

8. A reconfigurable seating system, comprising:

at least one seating unit having at least two mounting feet;

at least two floor plates, wherein a first one of the at least two floor plates includes at least one first mounting foot receptacle for releasably receiving a first mounting foot of the at least two mounting feet, wherein a second one of the at least two floor plates includes at least one second mounting foot receptacle for releasably receiving a second mounting foot of the at least two mounting feet, and wherein the at least one seating unit is pivotally adjustable between a substantially straight row orientation and a curved row orientation; and at least one floor plate attachment, wherein the at least one floor plate attachment is configured to secure the at least one seating unit, to an associated floor, in a predetermined location.

9. A reconfigurable seating system as in claim 8, wherein the at least one seating unit is adjustable between a first height and a second height.

10. A reconfigurable seating system as in claim 8, wherein the at least one seating unit includes a plurality of individual chairs.

11. A reconfigurable seating system as in claim 10, wherein at least one of the chairs, of the at least one seating unit, is foldable.

12. A reconfigurable seating system as in claim 8, wherein the at least one seating unit is adjustable between a flat floor orientation and a sloped floor orientation.

13. A reconfigurable seating system as in claim 8, wherein the at least one seating unit includes at least three chairs disposed side-by-side on a beam, wherein at least two of the at least three chairs includes a single arm, and wherein at least one of the at least three chairs includes two arms.

14. A reconfigurable seating system as in claim 8, further comprising a plurality of seating units arranged in at least two rows, wherein at least one of the at least two floor plates includes at least one third mounting foot receptacle for releasably receiving a third mounting foot, and wherein the third mounting foot is located in a second row different than a first row where the first and second mounting foot are located.

15. A reconfigurable seating system, comprising:

a plurality of seating units arranged in at least two rows;

at least one floor plate, wherein the at least one floor plate includes at least one first mounting foot receptacle for releasably receiving a first mounting foot of a first seating unit in a first row and a second mounting foot receptacle for releasably receiving a second mounting foot of a second seating unit in a second row, wherein the plurality of seating units adjustable between a flat floor orientation and a sloped floor orientation; and at least one floor plate attachment, wherein the at least one floor plate attachment is configured to secure the at least one seating unit, to an associated floor, in a predetermined location.

16. A reconfigurable seating system as in claim 15, wherein the plurality of seating units are adjustable between a first height and a second height.

17. A reconfigurable seating system as in claim 15, wherein at least one of the plurality of seating units includes a plurality of individual chairs.

18. A reconfigurable seating system as in claim 17, wherein at least one of the chairs, of at least one seating unit, is foldable.

19. A reconfigurable seating system as in claim 15, wherein at least one of the plurality of seating units is pivotally adjustable between a substantially straight row orientation and a curved row orientation.

20. A reconfigurable seating system as in claim 15, wherein at least one seating unit of the plurality of seating units includes at least three chairs disposed side-by-side on a beam, wherein at least two of the at least three chairs includes a single arm, and wherein at least one of the at least three chairs includes two arms.

* * * * *